US012709457B2

(12) United States Patent
Leizer et al.

(10) Patent No.: US 12,709,457 B2
(45) Date of Patent: Aug. 18, 2026

(54) CAN AND AN URGING MEMBER THEREFOR

(71) Applicant: Caniel Industries A. T. G. Ltd., Kfar Saba (IL)

(72) Inventors: Tal Leizer, Zikhron Ya'akov (IL); Arie Gabay, Ra'anana (IL); Lior Yemini, Shoham (IL); Offer Abramovitch, Givat Ada (IL); Menahem Salan, Rishon Lezion (IL); Pavel Gorodnitsky, Modiin (IL)

(73) Assignee: Caniel Industries A. T. G. Ltd., Kfar Saba (IL)

( * ) Notice: Subject to any disclaimer, the term of this patent is extended or adjusted under 35 U.S.C. 154(b) by 28 days.

(21) Appl. No.: 18/124,276

(22) Filed: Mar. 21, 2023

(65) Prior Publication Data

US 2023/0227237 A1 Jul. 20, 2023

Related U.S. Application Data

(63) Continuation-in-part of application No. 16/729,900, filed on Dec. 30, 2019, now abandoned.

(30) Foreign Application Priority Data

Dec. 30, 2018 (IL) ..... 264029
Sep. 1, 2019 (IL) ..... 269046

(51) Int. Cl.
*B65D 83/00* (2006.01)
*B65D 1/16* (2006.01)
*B65D 83/76* (2006.01)

(52) U.S. Cl.
CPC ..... *B65D 83/76* (2025.01); *B65D 1/165* (2013.01)

(58) Field of Classification Search
CPC ..... B65D 1/32; B65D 1/0261; B65D 1/0292; B65D 1/12; B65D 1/14; B65D 1/16;
(Continued)

(56) References Cited

U.S. PATENT DOCUMENTS 2,036,572 A * 4/1936 Frost ..... B65D 1/34 220/608
3,105,765 A 10/1963 Creegan
(Continued)

FOREIGN PATENT DOCUMENTS

DE 1982275 U 3/1968
DE 2909076 A1 9/1980
(Continued)

OTHER PUBLICATIONS

"Blue Tuna Press", https://www.surlatable.com/product/PRO-466425/Blue+Tuna+Press.
(Continued)

*Primary Examiner* — Robert Poon
(74) *Attorney, Agent, or Firm* — Ballard Spahr LLP

(57) ABSTRACT

An urging member configured to constitute a base for a can, comprising a peripheral edge, at which the urging member is to be connected to a side wall of a can at one end thereof to form a semi-fabricated can; an urgeable area surrounding having a normal state in which at least a central part of the area is outwardly convexly curved; and a pattern of elements formed in the urging member and located between the peripheral edge and a central axis thereof. The elements comprise at least one strengthening rib extending along the peripheral edge and protruding in the outward direction of the urging member, and urgeability-providing elements located between the central axis and the at least one strengthening rib. The urgeability-providing elements are angularly spaced from each other about the central axis, being radially
(Continued)

spaced from the strengthening rib and being configured to provide the urgeable area with the ability to be repeatably elastically displaceable in an inward direction, upon the manual application of an urging force to the urgeable area by at least one finger of a user, thereby changing the state of the urgeable area from a normal state in which the central portion of the area is disposed at a first location with respect to the reference plane, to a deformed state in which the central portion is disposed at a second location spaced from the reference plane to a greater distance than in the normal state; and in the outward direction upon release of the urging force, thereby changing the state of the urgeable area from the deformed state to the normal state.

24 Claims, 18 Drawing Sheets

(58) Field of Classification Search
CPC . B65D 1/165; B65D 7/24; B65D 7/00; B65D 7/02; B65D 7/04; B65D 83/0094; B65D 83/0055; B65D 35/06; B65D 79/0081; B65D 79/008; B65D 79/005
USPC ..... 220/660, 720, 723, 907, 608
See application file for complete search history.

(56) References Cited

U.S. PATENT DOCUMENTS

| | | | | |
|---|---|---|---|---|
| 3,872,994 | A | 3/1975 | Hyde | |
| 3,939,888 | A | 2/1976 | Scarnato | |
| 3,995,544 | A | 12/1976 | Farley | |
| 4,120,419 | A * | 10/1978 | Saunders | B65D 1/165 220/609 |
| 4,444,308 | A | 4/1984 | Macewen | |
| 5,706,721 | A | 1/1998 | Homes | |
| 6,333,060 | B1 | 12/2001 | Didonato | |
| 2003/0230202 | A1 | 12/2003 | Costahaude et al. | |
| 2006/0006133 | A1 | 1/2006 | Lisch et al. | |
| 2014/0263372 | A1 * | 9/2014 | Brewer | B65D 7/12 53/440 |
| 2017/0369198 | A1 | 12/2017 | Levy | |
| 2018/0229907 | A1 | 8/2018 | Gayer | |
| 2019/0152648 | A1 * | 5/2019 | Parve | B65D 85/70 |

FOREIGN PATENT DOCUMENTS

| | | | |
|---|---|---|---|
| DE | 7824267 | U1 | 1/1981 |
| EP | 0425124 | A1 | 5/1991 |
| FR | 1119542 | A | 6/1956 |
| GB | 1567518 | A | 5/1980 |
| JP | S50127784 | A | 10/1975 |
| JP | 2000184972 | A | 7/2000 |
| JP | 3110629 | U | 5/2005 |
| JP | 3169582 | U | 7/2011 |
| JP | 6356082 | B2 | 6/2018 |
| KR | 20100130549 | A | 12/2010 |
| WO | 2004052733 | A1 | 6/2004 |
| WO | 2015171876 | A1 | 11/2015 |
| WO | 2016060680 | A1 | 4/2016 |
| WO | 2016083860 | A1 | 6/2016 |

OTHER PUBLICATIONS

"Farberware Professional Tuna Press Box (Blue)", https://www.amazon.co.uk/Farberware-Professional-Tuna-Press-Blue/dp/B003IHUI7W.
"Snap Tuna Can Strainer Picture", https://www.amazon.com/Snap-Tuna-Can-Strainer-Canned/dp/B07N7RCVYL.
"Spurt No More Tuna Fish Can", https://caniel.co.il/innovation_product/spurt-no-more/, Mar. 22, 2022, 5 pages.
"Stainless Food Strainers Steel Can Sieve Tuna Press Lid Oil Drainer Remover", https://www.ebay.com/itm/Stainless-Steel-Food-Can-Strainer-Sieve-Tuna-Press-Lid-Oil-Drainer-Remover-/183455295465.
"Tuna Squish Can Openers: Kitchen and Dining", https://www.amazon.com/Patented-Flexible-Drainer-protects-yourself/dp/B00B1D8QBK.
"Tuna X Press", https://www.amazon.com/Tuna-Squish/dp/B00BOXF0NY/ref=cm_cr_arp_d_product_top?ie=UTF8.

* cited by examiner

CAN AND AN URGING MEMBER THEREFOR

TECHNOLOGICAL FIELD

The presently disclosure relates to a can for containing a product comprising at least one solid component and at least one liquid component with an urging member and/or a lid, configured to facilitate the removal of at least some of the liquid component prior to the removal of the solid component.

BACKGROUND

Cans for two-phase components have long been used in industries such as the food industry. When these phases are solid and liquid, such as preserved meats, fish, vegetables, fruit or other solids, it is usually desirable to drain off the preserving liquid before use is made of the solid edible component. The preserving liquid may be oil, water, brine, sugar water or other substance.

The opening of such cans has typically and conventionally been by either using an external tool, such as a can opening device for cutting through a lid or a side wall of the can, or using provisions provided on the lid itself, such as a ring-pull for tearing open the lid of the can along a pre-formed scored line, or a peel-back thin foil covering. In any of these cases, in order to drain the can, use is made of the lid as a means of filtering to prevent outflow of the solids while the liquids are being drained off. However, this is a messy procedure and can often result in oil, brine or the like making a mess on the fingers of the person squeezing the can, or splattering in many directions.

Various devices external to the can have been suggested in order to reduce splattering to a user. U.S. Patent Application Publication No. 2003/0230202 A1 teaches a flexible lid which may be fitted over an open can after the lid has been separated from the side wall of the can but not removed. The flexible lid has a hole therein, such that squeezing of the flexible lid in a direction which pushes the separated metal lid towards the base of the can causes the drainage liquid to be directed specifically through that hole and not to flow over a user's fingers if they are positioned away from the hole. A similar type of flexible-lid is disclosed in JP3169582, which has a spout for directing the flow of liquid to be drained from an opened can with the lid removed. U.S. Pat. No. 3,995,544 discloses a draining utensil, which can be used to squeeze out the liquid from an opened can which has had the lid removed.

U.S. Pat. No. 5,706,721 discloses a strainer which may be placed in a can either after opening or before it is sealed originally. The strainer has centrally located holes such that when the strainer is squeezed against the contents of the can, the liquid flows out through those holes.

WO 2015/171876 discloses a plastic container including a side wall and a flexible portion of a base. The flexible portion of the base deflects when the sealed plastic container experiences a differential pressure. The deflection of the flexible portion of the base acts to change the internal volume of the container and thereby reduce the differential pressure. The container is a retortable container and it may be injection-molded with inner and outer plastic layers and a core layer between the inner and outer plastic layers.

U.S. Pat. No. 6,333,060 discloses a container for packaging solid food stored in a liquid environment. One end of the container has a foraminous drain lid for draining the liquid from the container. The drain lid may have a rim to prevent a user from being splashed while draining the contents of the container. The container is sealed to prevent contamination of the contents of the container. The container may be made of a flexible material so that the user may squeeze the container to facilitate draining the liquid from the container. Once the liquid has been drained from the container, the drain lid is removed to allow extraction of the solid food from the container.

U.S. Patent Application Publication No. 2006/0006133 discloses a plastic container having a base portion adapted for vacuum pressure absorption. The base portion includes a central portion defined in at least part by a pushup and an inversion ring that generally circumscribes the pushup. The pushup and the inversion ring are moveable to accommodate vacuum related forces generated within the container.

General Description

According to one aspect of the present disclosure, there is provided a can for containing a product comprising at least one solid component and at least one liquid component, the can comprising the following features at least in an ready-for-sale state of the can with the product: a lid hermetically sealing the can and being at least partially openable to allow at least partial removal of the product from the can, a base opposite the lid and a side wall extending therebetween; the base constituting an urging member configured to be urged inwardly, at least when the lid is partially opened, by a user applying to the base an urging force, which exceeds a pre-determined threshold, thereby changing the state of the base between a first state, in which the can has a first contained volume, and a second, deformed state, in which the can has a reduced contained volume smaller than the first contained volume.

According to another aspect of the present disclosure, there is provided an urging member for use as a base of a can, which in a ready-for-sale state comprises said base fixedly connected to a side wall at one end thereof and a lid hermetically sealing the can at the other end of the side wall, the urging member comprising a continuous solid body having a peripheral edge lying in a reference plane, said body being configured to be urged in a pre-determined direction, when the peripheral edge is fixedly held in place, by a user applying an urging force to the body, at a location spaced from the peripheral edge, an urging force which exceeds a pre-determined threshold, thereby changing the state of the urging member from a first state to a second, deformed state, both states being characterized by a volume contained between (a) the body, (b) a first imaginary surface parallel to the reference plane and spaced therefrom in said direction to a distance greater than that between the reference plane and any point of said body in the deformed state, and (c) a second imaginary surface perpendicular to the first imaginary surface and extending between the first imaginary surface and said peripheral edge; said volume being an first volume in the first state of the body and a second, reduced volume smaller than the first volume in the second, deformed state of the body; the urging member being configured to be fixedly connected to the side wall of the can with the pre-determined urging direction directed towards the inside of the can so as to be urgeable inwardly in said can, at least when the lid is partially opened, by a user applying to the base said urging force.

The urging member in both the above aspects can be configured so that its deformation from its initial state into the deformed state thereof upon single application of the urging force, is a plastic deformation.

Alternatively, the urging member in both the above aspects can be configured to be elastically deformed upon the application of the urging force smaller than a pre-determined threshold force $F_{plastic}$, at which the urging member would undergo plastic deformation, and to return back to an initial, non-deformed or to a less deformed state upon release of the urging force. In this case, the urging member should be made of material and have configuration allowing it to have elastic properties suitable for the urging member to be elastically deformed in a repeated manner, so as to return each time from the deformed state to a state the same as, or close to, its initial state.

Thus, according to further aspect of the present disclosure, there is provided a can for containing a product comprising at least one solid component and at least one liquid component, the can comprising the following features at least in the ready-for-sale state of the can with the product: a lid hermetically sealing the can and at least partially openable to allow at least partial removal of the product from the can, a base opposite the lid and a side wall extending therebetween; and the base constituting an urging member configured to be urged inwardly, when the lid is at least partially opened, by a user applying to the base an urging force, which exceeds a pre-determined threshold, thereby changing the state of the base from a first state, in which the can has an first contained volume, into a second, deformed state, in which the can has a reduced contained volume smaller than the first contained volume, wherein the base is configured, at least when the lid is partially opened, to be elastically deformed in a repeated manner from the first state to the second, deformed state upon the application of urging force and to return each time from the second state to the first state when the urging force is released, and wherein such repeated change of the state of the base between the first and second states results in the corresponding repeated change of the contained volume of the can.

According to yet another aspect of the present disclosure, there is provided an urging member for use as a base of a can having a side wall and a lid hermetically sealing the can, the urging member comprising a continuous solid body having a peripheral edge lying in a reference plane, said body being configured to be urged in a pre-determined direction, when the peripheral edge is fixedly held in place, by a user applying to the body, at a location spaced from the peripheral edge, an urging force which exceeds a pre-determined threshold, thereby changing the state of the urging member from first state to a second, deformed state, both states being characterized by a volume contained between (a) the body, (b) a first imaginary surface parallel to the reference plane and spaced therefrom in said direction to a distance greater than that between the reference plane and any point of said body in the deformed state, and (c) a second imaginary surface perpendicular to the first imaginary surface and extending between the first imaginary surface and said peripheral edge; said volume being an first volume in the first state of the body and a second, reduced volume smaller than the first volume in the deformed state of the body; the urging member being configured to be fixedly connected to the side wall of the can with the pre-determined urging direction directed towards the inside of the can so as to be, at least when the lid is partially opened, repeatedly elastically deformable from the first state to the second, deformed state upon the application of said urging force and return back from the second state to the first state when the urging force is released, and wherein such repeated change of the state of the base between the two states causes the corresponding change of the contained volume of the can.

In accordance with any one of the above aspects of the presently disclose subject matter, the can or the urging member when constituting a base of a can with a lid, which is configured for containing a product comprising at least one solid component and at least one liquid component, has an exterior surface which can bear, at least prior to the use thereof, instructions for a user to apply the urging force to the base, once or repeatedly, after the lid has been opened to an extent sufficient for the liquid component to pass through the opened area of the lid while preventing the solid component from leaving the can.

According to another further aspect of the present disclosure, there is provided a can for containing a product comprising at least one solid component and at least one liquid component, the can comprising the following features at least ready-for-sale state of the can with the product: a lid at least partially openable to allow at least partial removal of the product from the can, a base opposite the lid and a side wall extending therebetween; and the base constituting an urging member configured to be urged inwardly by a user applying thereto an urging force, thereby changing the state of the urging member from an initial state, in which the can has an initial contained volume, into a deformed state, in which the can has a reduced contained volume smaller than the initial contained volume, wherein optionally, the urging member is configured to be elastically deformed in a repeated manner by the application and release of the urging force to correspondingly repeatedly change of the contained volume of the can, wherein the can further comprises an exterior surface which bears, at least prior to the opening of the lid, instructions for a user to apply, optionally repeatedly, the urging force to the base after the lid has been opened to an extent sufficient for the liquid component to pass therethrough while preventing the solid component from passing therethrough.

The above instructions can further comprise an instruction to orient the can so that the open portion of the lid faces at least partially downwards.

In the present description and embodiments, the term 'first state' can mean either the initial state or a state close to the initial state, i.e. closer to the initial state than to the deformed state.

The urging member can be made of a metal and can be configured, when designed to be elastically deformable, to change its orientation between the non-deformed and deformed states, a number of times upon the corresponding repeated application and release of the urging force by a user. This number can be more than 10, more particularly, more than 20, still more particularly, more than 30, and still more particularly, at least 50.

By virtue of the above capability of the urging member to elastically change its state, it can be allowed to function as a membrane in a pump, e.g. a dozing pump, to gradually and controllably pump out the liquid component from the can, when the lid is opened to an extent sufficient for the liquid product component to be pushed out of the can while preventing the solid component from leaving the can when the urging force is applied to the base, and not greater than that needed for air from the exterior of the can to be subsequently sucked into the can when the urging force is released. In this case the desired extent of the opening can be reached by a user opening the lid first to a minimal extent and trying to operate the base as a membrane and subsequently increasing the extent if needed until the desired membrane-like functioning of the base is achieved. Alternatively, the lid can be formed with a pre-fabricated initial-access area having such pre-defined configuration that, when the lid is opened to expose this area and provide therethrough an initial access to the interior of the can, this access is such as, on the one hand, to allow the air to be sucked into the can following or simultaneously with pushing the liquid component out of the can, thereby replacing the liquid component within the can upon the application by a user of an urging force to the base, and on the other hand to prevent said access from being clogged by the solid product component. One example of the shape of such initial-access area is a non-axisymmetric, e.g. a non-circular, shape. As to the dimensions of the initial access area, it can be determined by try-and-error experiments with a given material having suitable mechanical properties, depending on the contained volume of the can and properties of the liquid and solid components of the product.

According to a further aspect of the present disclosure, there is provided a can comprising a base in the form of any urging member as described above.

The base can be configured to be operated to employ its capability to function as an urging member, only when the lid is at least partially opened. Alternatively, the base can be configured for being brought into a maximally deformed state, at which the can has a minimal contained volume, only when the lid is open.

The reduced contained volume of the can can be substantially smaller than the initial volume and its minimal value equal to that of the solid component of the product. For example, it can be at least 10% smaller than an initial contained volume, particularly, at least 15% smaller than the initial volume, and still more particularly, at least 20% smaller than the initial volume. The maximal reduced volume of the can can be at least 25% smaller than the initial volume, more particularly, about 30% smaller than the initial volume of the can.

The application of the urging force by a user normally refers to the application of such force manually, though in general one can think of some simple mechanical device for repeatedly applying to the urging member the urging force.

The ready-for-sale state of the can with the product refers to a completed hermetically sealed can comprising the product, as stored in ambient or other storage conditions for any length of time during the shelf life of the product, i.e. just before the can is opened for using the product. The phrase 'completed can comprising the product' means that the can with the product has undergone all manufacturing stages needed to bring the can with the product into condition for sale, including if required any after-sealing treatment such as pasteurization, retorting, sterilization or the like.

The base is free of the capability of being opened or removed from the can under normal use thereof. Rather, the can is configured to be opened only by opening the lid, e.g. by separating at least a part of the lid from the side wall or by separating one part of the lid from another part of the lid, in order to provide a desired access to the interior of the can.

Since the lid is openable and the base constitutes an urging member, a user can urge the base to reduce the contained volume in the can, causing at least some of the product within the can, normally at least a part of the liquid component, to be forced out of the opened lid by the reduction of contained volume in the can, without soiling or otherwise making a mess over his/her fingers when urging or pressing the urging member towards the interior of the can. The liquid component can thus exit the can at a different part of the can than that where a user's fingers apply the urging force, resulting in a tidier and less-messy operation. In addition, using the base as the urging member operable as described above in a can containing liquid and solid product components, allows to eliminate or at least essentially reduce the impact on the solid component, a majority of which can thus substantially maintain its initial state while the liquid component is pushed out of the can. This is contrary to situations when liquid is squeezed from a can by pressing its at least partially separated lid inwardly (as is often done by users of conventional cans containing liquid and solid product components) or squeezing side walls of a can as suggested e.g. in U.S. Pat. No. 6,333,060.

The base, the lid and the side wall of the can are its components, all of which can be produced separately and subsequently sealingly fixed to each other. In this case, the base can be produced separately as a body having a peripheral edge, along which the body is configured to be integrally mounted to the side wall. Alternatively, the base and the side wall can be formed as a unitary body, such as e.g. in a stamping operation.

A can with the urging member or an urging member according to any of the above aspects can further have any one or more of the features of any aspect and embodiment presented below.

The capability of the urging member to be urged between the two states can be due to the mechanical properties of the material, from which the urging member is made or/and due to the configuration of its body. In the latter case, the urging member having said configuration can be made of a material which is sufficiently stiff to prevent the urging of the urging member if this member of the same thickness were to be free of said configuration.

Such a stiff material can be sufficiently structurally rigid and sturdy to allow the base made therefrom to withstand, without changing its above urging capability, the conditions to which cans are usually subjected in their hermetically sealed state, including elevated or reduced temperatures, impacts due to accidental dropping, long-term stresses such as where heavy cans or crates are stacked on top of cans, and higher or lower pressures.

The material can comprise, or can be, metal, optionally tin. Metal, and optionally, tin, is used in, i.e. to form, cans or parts thereof on a regular basis. Metal, particularly in sheet form, has a high strength to weight ratio, as well as being easily formable into shapes and joinable to create a hermetically sealable container. Metal is also structurally stiff to resist deformation, and is ductile enough to be able to sustain some deformation without breaking the hermetic seal of the can. Furthermore, metal cans are the preferred choice for canning food due to their inherent ability to withstand after-sealing treatment without essentially changing their original configuration/orientation.

The body of the urging member can comprise a central area and an intermediate area extending between the central area and the peripheral edge. The orientation of the intermediate area relative to the central area and to the peripheral edge can be different in the initial and deformed states of the urging member. In the initial state, the intermediate area can extend from the peripheral edge towards an exterior of the can and in the deformed state of the urging member, the intermediate area can extend towards an interior of the can.

With this arrangement, the intermediate area can change its direction of extension in order to reduce the contained volume. This constitutes an effective at least partial eversion of the body of the base.

In the initial state of the urging member, the body of the urging member can be generally convex in shape, and in the deformed state of the urging member, the body of the urging member can be generally planar or concave in shape.

In the initial state of the urging member, it can be substantially dome-shaped. Dome-shaped bodies are generally efficient for withstanding pressure, such as hydrostatic pressures which may be applied to the can during its production, filling, hermetic sealing or subsequent processing.

The shape of the central area can be configured to be maintained unchanged between the initial and deformed states of the urging member.

The central area of the body can be stiffer than the intermediate area, such that the intermediate area deforms preferentially to the central area under the application of said urging force to the urging member.

In this way, the maintenance of stability and shape of the can in spite of the deformation of the intermediate area surrounding the central area can be facilitated.

The difference in stiffness between the central and intermediate areas of the body can be obtained by virtue of corresponding configuration thereof. In particular, the intermediate area can be formed with a shape/geometry facilitating its deformation as desired. For example, the intermediate area of the body can be formed with a number of grooves extending from the central area towards the peripheral edge and spaced from each other, so as to divide the intermediate area into a corresponding number of sections, which can be in the form of annular sectors, which change their mutual orientation under the application of the urging force to the intermediate area.

In this arrangement, the grooves can be configured to allow the sections disposed on either side of each groove to change their mutual orientation upon the application of the urging force, thereby facilitating the eversion and/or change of shape of the body when brought from the initial state into its deformed state.

The central area of the body can be recessed relative to at least an adjacent portion of the intermediate area. Such a stepped configuration can also allow easier change of shape from the initial state to the deformed state of the urging member.

The can may be configured to undergo the temperature and pressure differential conditions of after-sealing processing such as any one of pasteurization, retorting, sterilization or the like.

More particularly, the can can be configured to withstand a pressure differential between the inside and outside of the can of 150 KPa without buckling.

The can can be configured to withstand elevated temperatures of up to 145° C. and ambient and cold storage conditions acceptable for canned food and the like.

In a can according to any one of the above aspects and embodiments, the product can be a food product, e.g. tuna, and the can can comprise the product.

A can and an urging member according to any of the above aspects and embodiments can have a round shape in a plan view.

An urging member according to any of the above aspects and embodiments can have at least one strengthening rib adjacent to its peripheral edge.

An urging member and/or a can according to any of the above aspects and embodiments can be produced using the same technology as that conventionally used for the same products. For example, in case the food product is tuna which today is mostly sold in round metal tuna cans, the urging member can be produced with a peripheral edge having the same configuration and configured to be connected to the side wall of the can in the same way as in the conventional tuna cans.

The can according to any of the above aspects and embodiments can further comprise: a central axis passing through each of the lid and the base and extending therebetween; a first opening arrangement, which in operation thereof is configured to allow removal of the liquid component while preventing removal of the solid component; and a second opening arrangement which in operation thereof is configured to allow removal of the solid component and which, at least in an initial state of the lid, is spaced from the first opening arrangement by a portion of the lid preventing the passage of at least the solid component through this portion, the spacing being in a plane perpendicular to the central axis.

With this arrangement, the liquid component can be removed from the can while the solid component is retained, and subsequently the solid component, drained of the liquid component can be removed. Since the first and second opening arrangements are spaced from one another, the second opening arrangement need not get soiled by liquid component exiting from the first opening arrangement.

At least in operation of the first opening arrangement and second opening arrangement, the first opening arrangement can comprise at least one first aperture formed in the lid and the second opening arrangement can comprise at least one second aperture formed in the lid and different from the first aperture.

By providing separate apertures for each opening arrangement, the apertures can be tailored to the appropriate material to be removed therefrom. For example, the size and dimensions of the apertures can be selected and optimized to suit the at least one of the components of the product to be canned, e.g. the shape and size of the solid component in the can.

The first aperture can be smaller than the second aperture, and optionally, the at least one first aperture can be a plurality of first apertures, and the at least one second aperture can be a single aperture which is larger than each of the first apertures.

The first aperture/s can be configured to provide a filtering effect, so that the solid component will be prevented from being able to leave the can, while the liquid component can easily flow out of the first aperture/s. The second aperture can be configured so as to facilitate the removal of the solid component therethrough from the can. In the event that a plurality of first apertures are provided, the liquid component will be able to drain faster and more efficiently from the can without the solid component being able to exit the can.

The first opening arrangement can comprise a pull-tab configured to be operated to detach a first portion of the lid from the remainder of the lid and thereby produce said, or expose at least one first aperture in the case that the at least one first aperture was pre-fabricated.

In the event that the at least one first aperture is produced (rather than being pre-fabricated), this can be achieved by tearing of the lid, whereas the exposure of at least one first pre-fabricated aperture can be achieved by peeling back a covering portion or covering layer of the lid.

The pull-tab can be a single pull-tab constituting a part of the first and the second opening arrangements, configured so that operating the pull-tab to detach at least the first portion of the lid from the remainder of the lid produces or exposes, in sequence with the extent of detaching the lid, first said at least one first aperture and then said at least one second aperture.

With this arrangement, a single pull-tab can provide dual functionality to operate the first and second opening arrangements in sequence, to first drain the liquid component from the can, followed by allowing removal of the solid component from the can.

The above pull-tab of the first opening arrangement can be a first pull-tab configured to be operated to detach from the remainder of the lid a first portion of the lid, and the second opening arrangement can comprise a second pull-tab configured to be operated to detach from the remainder of the lid a second portion of the lid other than the first portion of the lid and thereby produce the at least one second aperture or expose it if pre-fabricated. With this arrangement, if the first pull-tab becomes soiled by the draining of the liquid component, the second pull-tab will remain clean, allowing removal of the solid component from the can without the use getting dirty hands.

The lid can comprise, or be made of, the same material as the remainder of the can, and the pull-tabs can be in the form of ring-pulls. This can simplify processing and joining costs and operations when providing the can.

The lid can comprise a layer of metal foil, and said pull-tab/s can be in the form of pull-tag/s. The lid can be in the form of a laminated structure having at least a foil layer, and optionally also a polymer layer.

The first portion of the lid can have an area smaller than that of the second portion of the lid, thereby allowing operation of the first pull-tab to detach the first portion of the lid to a first extent which is smaller than a second extent to which the second portion of the lid is detachable by operation of the second pull-tab.

Such a lesser first extent of detachment may prevent accidental exposure or production of the second aperture, and thereby prevent accidental release of solid component from the can. Further, the second aperture as a result can be formed to have a larger area, to allow easier removal of the solid component from the can once the liquid component has been drained therefrom.

The lid can further comprise: a support surface surrounding a single aperture occupying a majority of the lid's area; and a covering layer covering the aperture and secured to the support surface, the covering layer being selectively detachable from the support surface to expose a first portion of the aperture, to thereby provide the first opening arrangement, and selectively detachable from the support surface to expose a second portion of the aperture, at least a part of which is spaced from the first portion to provide the second opening arrangement, and wherein optionally, the first portion is smaller than the second portion.

This arrangement provides a simplified can which still has two spaced opening arrangements.

The can can also comprise a direction control component associated with the first opening arrangement, for controlling the direction of flow of the liquid component during transfer of the liquid component via the first opening arrangement.

Such a direction control component can redirect the stream of emerging liquid from the can along a specific pathway and therefore avoid mess and the spread of liquid component onto the hands of the user, or any pull tab of the first opening arrangement.

The direction control component can be removable from the lid, for example, by tearing or peeling off.

The can can further comprise a strainer disposed within the can proximate to the lid, the strainer comprising at least one or more smaller apertures configured for drainage of liquid from the can while retaining the solid component within the can, and a single larger aperture configured for the removal of the solid component from the can.

The strainer can be fixedly arranged relative to the side wall of the can, so as not to be moveable within the can.

According to a further aspect of the present disclosure, there is provided a can for containing a product comprising at least one solid component and at least one liquid component, the can comprising the following features: a lid, a base and a side wall extending therebetween; a central axis passing through each of the lid and the base and extending therebetween; a first opening arrangement, which in operation thereof is configured to allow removal of the liquid component while preventing removal of the solid component; and a second opening arrangement which in operation thereof is configured to allow removal of the solid component and which, at least in an initial state of the lid, is spaced from the first opening arrangement by a portion of the lid preventing the passage of at least the solid component through this portion, the spacing being in a plane perpendicular to the central axis.

According to a still further aspect of the present disclosure, there is provided a lid for use with a can for containing a product comprising at least one solid component and at least one liquid component, the can comprising a base and a side wall, the lid having two sides, one of which is configured to face toward an interior of the can when the lid is mounted to the side wall of the can, and a central axis extending between the two sides, the lid further comprising: a first opening arrangement, which in operation thereof is configured to allow transfer of the liquid component from one side of the lid to the other side of the lid while preventing removal of the solid component together with the liquid component; a second opening arrangement, which in operation thereof, is configured to allow removal of the solid component from said one side of the lid to said other side of the lid, the second opening arrangement being, at least in an initial state of the lid, spaced from the first opening arrangement by a portion of the lid preventing the passage of at least the solid component through this portion, the spacing being in a plane perpendicular to the central axis; and a lid peripheral edge, along which the lid is configured to be mounted to the side wall of the can at an end of the side wall opposite to that at which the base is connected to the side wall.

The lid of the can can be formed separately from the remainder of the components of the can, so as to be integrally attached to the side wall of the can during the production of the can.

According to yet another aspect of the present disclosure, there is provided a strainer for a can comprising at least one first aperture and at least one second aperture, the first and second apertures being different in at least one of size and shape so as to allow a liquid product component to pass through the at least one first aperture while preventing a solid component from such passage, and to allow a solid product component to be subsequently removed from the at least one second aperture. The strainer can be an integral part of a can or a part insertable into a can.

The first and second apertures can have any features of the apertures/openings of the first and second opening arrangements described above.

In accordance with any one of the above aspects of the presently disclose subject matter, the volume ratio of the can or the can having the urging member constituting the base thereof, between the deformed state of the urging member (i.e. initial contained volume) and the initial state of the urging member (i.e. reduced contained volume), is between 0.5-0.95. Throughout the specification, use of the term "solid" when referring to the solid component does not reflect the extent of solidity of the solid component, but rather is a relative term meaning that the solid component is in a state more solid than the liquid component.

Throughout the specification, the meaning of the term "opening arrangement" depends on whether openings thereof are pre-fabricated or are produced in the operation of the arrangements. In the former case, the term "opening arrangement" means an arrangement which includes pre-fabricated openings and is operable to expose these openings to an exterior of the can. In this case, the spacing between the first and second opening arrangements can be considered to be the spacing between the openings of these two arrangements.

In latter case, where the can does not have pre-fabricated openings, the term "opening arrangement" means an element of the can manipulable to produce, and in doing so expose, openings to the exterior of the can, e.g. openings in the lid. In this case, the spacing between the first and second opening arrangements can be considered to be the spacing between the respective manipulable elements of these.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1A:
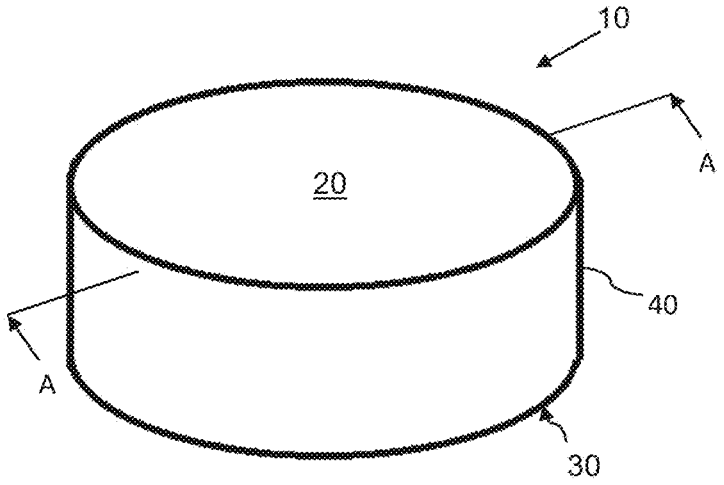
FIG. 1A shows a top perspective view of a typical can in which the presently disclosed subject matter can be used.
Figure 1B:
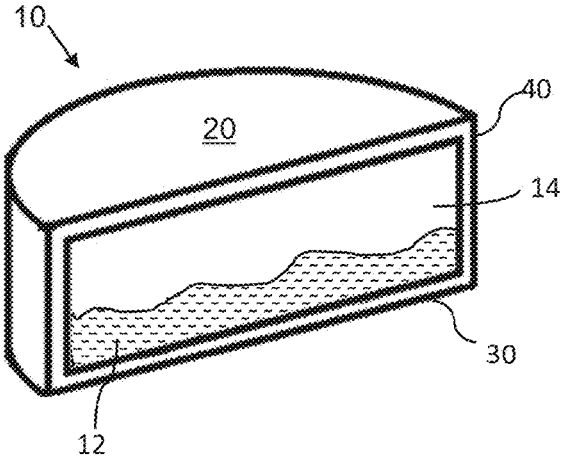
FIG. 1B shows a cross-sectional view of the can of FIG. 1A including contents of the can, taken along a central plane of symmetry A-A of the can.

FIGS. 1A and 1B show a typical can 10 containing a product comprising at least one solid component and at least one liquid component. The product can be an edible or other preserved product, i.e. the can can be a can for food storage and can comprise the product. The can is shown in its ready-for-sale, hermetically sealed state with the product, and the solid and liquid components are seen in FIG. 1B, where they are designated as 12 and 14 respectively.

The can 10 in its above state comprises a lid 20, which is at least partially openable (not shown) to allow at least partial removal of the product—e.g. only the liquid 14 or the solid 12 components, or some or all of both, from the can 10. The can 10 further has a base 30 opposite the lid 20, and a side wall 40 extending between the base 30 and the lid 20.

The base 30 and the side wall 40 of the can can constitute a unitary body or the base can be fixedly connected to the side walls to form an integral body, so as to form a receptacle (not shown), to which the lid is configured to be hermetically sealingly mounted to form the can 10.

The can 10 or at least its base 30 is made of a material and is configured to undergo and withstand, without the buckling or other essential deformation, after-sealing treatments of the can required for processing canned food and known in the art, such as any one or more of pasteurization, or retorting or sterilization. These may include differential pressure, i.e. a pressure differential between the inside and outside of the can of at least 150 KPa.

The can can also be configured to withstand elevated temperatures of up to 145° C. and ambient and cold storage conditions acceptable for canned food and the like.

The solid product 12 inside the can 10 can be any edible product such as meat, fish, pet food, fruit, vegetables or the like for example, and the liquid product 14 inside the can 10 may be any preserving liquid such as oil, water, brine, syrup, fruit juice or the like, for example. In a more specific example, the can may be a tuna can.

All components of the can 10, namely the lid 20, base 30 and side wall 40, or at least some of them can be made of a metallic material, or a material comprising a metallic material. For example, a laminated material may be used in the form of a plate comprising at least one of aluminum, steel or tin, optionally with one or more layers of a polymer. Alternatively, one or more of the lid 20, base 30 and side wall 40 can be made of a polymer or polymer-comprising material. Different parts of the can can be made of different materials. For example, the side wall can be made of a material different from that of the base and/or the lid, or the lid, the side wall and the base can all be made of different materials. The material from which the can or any part thereof can be made can be a metal or non-metal material comprising a polymer. Examples of metal are aluminum, tin, iron or steel coated with tin, and examples of non-metal materials are rigid synthetic materials made from organic polymers.

Figure 1C:
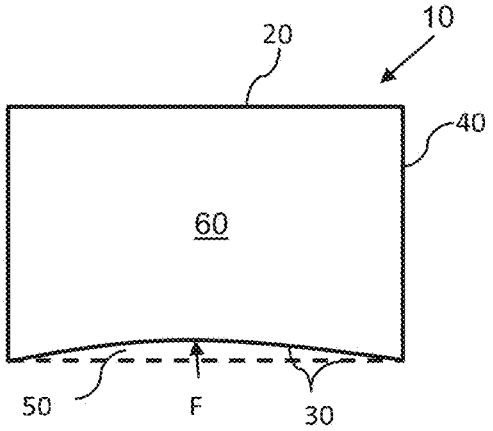
FIG. 1C is a schematic representation of the profile of an urgable base of a can according to one embodiment of the presently disclosed subject matter in a cross-sectional view of the base taken along its central plane of symmetry, the profile being shown in a deformed state of the base in solid line and in an initial state of the base in dotted line.
Figure 1D:
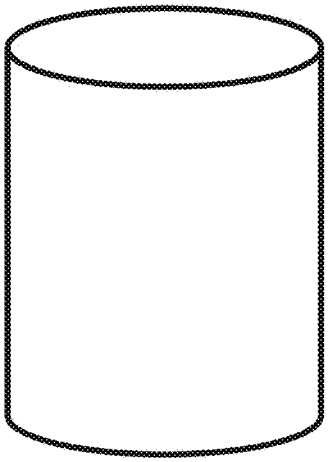
FIGS. 1D and 1E show top perspective views of other typical cans in which the presently disclosed subject matter can be used.
Figure 1E:
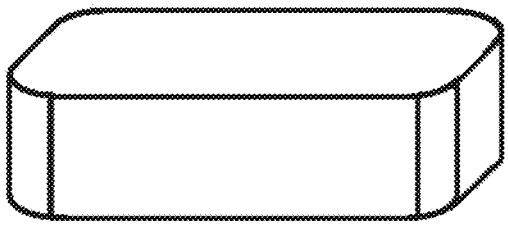

Although the can 10 is shown as a cylindrical container, this is not a limitation and other shapes are envisaged, for example a cuboid including with rounded corners and/or edges, an elongated cylinder or other shape as shown in FIGS. 1D and 1E.

The lid 20 can be of any conventional design. In particular, it can be openable by use of a can opener or other cutting device or comprise a scored line and a ring pull for tearing open the lid 20 along the scored line. The lid 20 can alternatively comprise a support surface arranged around at least a portion of the periphery of the side wall 40, for attachment by adhesive or other means of a peelable metallic foil or polymer film covering layer for hermetically sealing the can.

The can 10 can be manufactured in a number of ways. For example, the base 30 and/or lid 20 may be formed integrally with the side wall 40 of the can 10, for example in stamping operations, or may be formed separately and subsequently attached to the side wall 40 of the can 10 through known methods and processes such as joining with seam for example. Other processes are also suitable and would be known to the skilled person.

The above description of the typical can 10 having a ready-for-sale state in which it is hermetically sealed by the openable lid, fully applies to a can of the present example, except that the base of the present example is made of metal and has such a configuration as to be deformed at least once, when urged by a user towards the interior of the can, to reduce the contained volume of the can at least after the lid of the can has been at least partially opened. Moreover, in the present example, this metallic base, which will be hereafter referred to as an 'urging member' of the can, is made of such material which is sufficiently stiff to prevent deformation thereof if it were to be free of the above configuration while having the same thickness. The term 'configuration' in the context of the capability of the above urging member to be urged inwardly, means at least its configuration as seen from the exterior of the can.

FIG. 1C illustrates the above function of the urging member of the can 10*s* constituted by the base 30, according to one embodiment of the presently disclosed subject matter. In FIG. 1C, the base 30 is shown to have been urged inwardly by the application thereto of an urging force F exceeding a pre-determined threshold force $F_{Thresh}$, the letter being a force at which the desired deformation can yet not be obtained (see the solid line, rather than the dotted line which shows the initial state of the base 30). The force F can be applied at one or more locations of the base 30, and the pre-determined threshold $F_{Thresh}$ for the force F must be suitably low to allow users to easily deform the base 30, e.g. using their fingers, without the need for other devices or gadgets. FIG. 1C shows the can 10 with the base 30 in a deformed state, see the solid line of the base 30, in which the can 10 has a contained volume 60 smaller than an initial contained volume 50 in an initial state of the base 30 of the can 10 (shown in dotted lines).

Under normal, reasonable use as expected for a can, the base can be deformable in the above manner, i.e. into its final shape, or deformed state by the application of sufficient external force, only when the lid 20 has been opened, i.e. to an extent sufficient to allow at least some of the contents of the can 10, e.g. the liquid component 14, to be removed. Otherwise the can 10 would not be able to structurally withstand the much greater pasteurization and sterilization conditions required. Conversely, when the can is hermetically sealed-closed, such deformation from the initial state to the deformed state is prevented by the physical resistance to compression of the liquid and solid in the can.

In operation, a user opens the lid 20 at least partially, inverts the can 10 to allow the gravitational force to cause the product to accelerate downwards, and applies a force F greater than the threshold force $F_{Thresh}$ to the base 30 of the can 10. The base 30, as a result of this urging, moves from the initial state, where the can 10 has the first volume 50, to the deformed state where the can has the second, reduced volume 60.

Figure 1F:
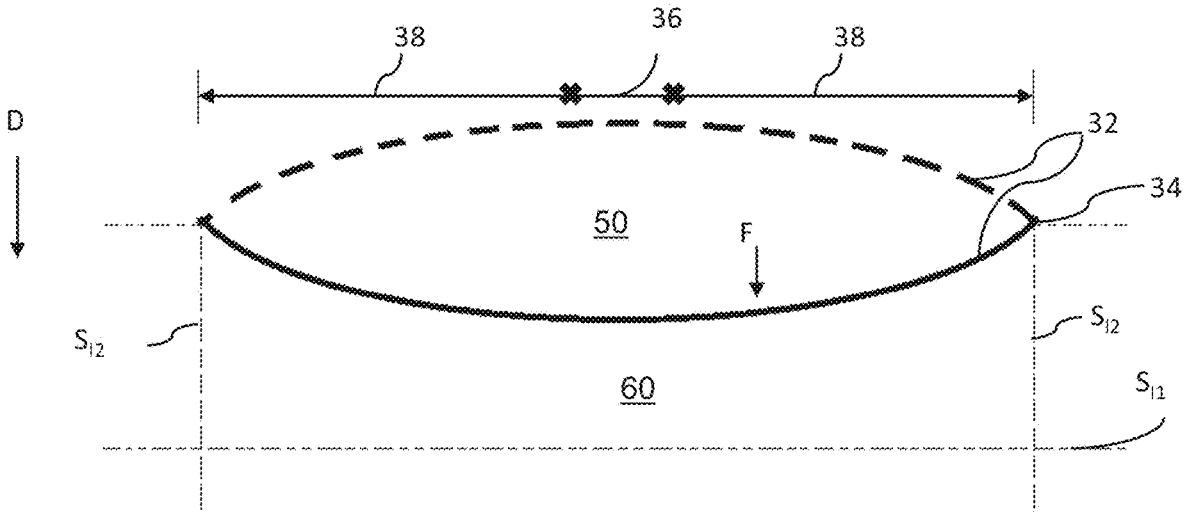
FIG. 1F is a schematic representation of the profile of an urgable base when produced as a separate continuous solid body according to a further embodiment of the presently disclosed subject matter in a cross-sectional view taken along the central plane of symmetry, the profile being shown in a deformed state of the base in solid line and in an initial state of the base in dotted line.

As mentioned above, the base 30 can be produced as a separate body and then fixedly attached to the side wall of the can, or be formed as a unitary body at least with the side wall 40 of the can. FIG. 1F schematically illustrates the above operation of base 30 when produced as a separate continuous solid body 32 having a peripheral edge 34, along which the body 32 is configured to be fixedly connected to a side wall of a can, such as the side wall 40 of the can 10 described above with reference to FIGS. 1A-1E.

The body 32 has a central area 36 and an intermediate area 38 extending between the central area 36 and the peripheral edge 34. The body 32 is configured to be urged in a pre-determined urging direction D, when the peripheral edge 34 of the body 32 is fixedly held in place, by the application of a force F to the body 32 at a location of the body 32 spaced from the peripheral edge 34. In order for the body 32 to be urged, the force F applied thereto must be greater than the threshold force $F_{Thresh}$, i.e. $F>F_{Thresh}$. The location spaced from the peripheral edge 34 may be at a center of the body 32, e.g. in the central area 36, and/or anywhere between the center and the peripheral edge 34.

The operation of the body 32, imitating its behavior when used as the base of a can, is described below with reference to FIG. 1F, where the body 32 is shown in solid line its deformed state relative to its initial state shown in dotted line. In FIG. 1F, the following imaginary planes are used for the description of the operation of the body 32:

- a reference plane $P_R$, in which the peripheral edge 34 of the body 32 lies;
- a first imaginary surface $S_{I1}$ parallel to the reference plane $P_R$ and spaced from the reference plane $P_R$ in the urging direction D to a distance greater than that between the reference plane $P_R$ and any point of the body 32 in the deformed state, and
- a second imaginary surface $S_{I2}$ perpendicular to the first imaginary surface $S_{I1}$ and extending between the first imaginary surface $S_{I1}$ and the peripheral edge 34.

In the initial state of the body 32 an initial volume 50 is contained between the body 32, the first imaginary surface $S_{I1}$ and the second imaginary surface $S_{I2}$. In the deformed state of the body 32 a reduced volume 60 is contained between the body 32, the first imaginary surface $S_{I1}$ and the second imaginary surface $S_{I2}$. The reduced volume 60 is smaller than the initial volume 50.

When the body 32 as an urging member is fixedly mounted to, or unitarily formed with, a side wall of a can, such as side wall 40 of can 10 in FIGS. 1A-1E, the arrangement is such that the direction D, which is the urging direction of the base 30 is towards the inside of the can 10.

As seen in FIG. 1F, in the initial state of the body 32, the intermediate area 38 extends from the peripheral edge 34 towards the central area 36 in a direction opposite to the urging direction D. Were the body 32 to be attached to a side wall of a can, this direction of extension would be towards an exterior of the can, i.e. away from the inside of the can. Conversely, in the deformed state of the body 32, as shown by the dotted line, the intermediate area 38 extends from the peripheral edge 34 towards the central area 36 generally downwards, i.e. in the same direction D as the urging direction. Were the body 32 to be attached to a side wall of a can, this direction of extension would be towards an interior of the can, i.e. towards the inside of the can.

In the described example, the body 32 can be seen to be generally convex in shape in its initial state, whereas in its deformed state, the body 32 is generally concave in shape. By concave and convex, what is meant is generally bowing in the urging direction D and generally bowing in a direction opposite to the urging direction D. In FIG. 1F these directions are below and above the reference plane $P_R$ respectively.

In this particular example, in the initial state the body 32 is substantially dome-shaped. By dome shaped, what is meant is generally resembling at least in part the upper portion of a sphere, i.e. the surface curving generally towards a central point by extending from the peripheral edge 34 towards the central area 36 in a direction opposite to the urging direction D, the gradient of the curve being increased towards the peripheral edge 34 and decreased towards the central area 36.

The central area 36 of the body 32 can be stiffer than the intermediate area 38. In this case, under the application of urging force F greater than the threshold force $F_{Thresh}$ to the body 32, when its peripheral edge is fixed in place, the intermediate area 38 can deform preferentially to the central area 36. In this case (not shown in FIG. 1F, the central area 36 can maintain its shape in both states of the body 32, i.e. remain undeformed even in the deformed state of the body 32, whereas the intermediate area 38 changes its shape or configuration, i.e. deforms, when moving from the initial state to the deformed state of the body 32.

It should be understood that the particular shape of the initial and deformed states of the base 30 in FIGS. 1C and 1F are merely exemplary, and other possibilities are envisaged. For example, without limitation, the base 30 can have an initial convex configuration in the initial state and a less convex, planar or concave configuration in the deformed state.

Various configurations of the body 32 may be provided, which allow its use as a base of a can and to be urged under the applied force F above the threshold force $F_{Thresh}$ from the initial state to the deformed state. These configurations can include providing at least the intermediate area 36 of the body 32 with a shape which at least partially changes between its initial and deformed state. Non-limiting examples of such configurations are shown in FIGS. 2A-2F, 3A-3C, 4A-4D and 5A-5C.

Figure 2A:
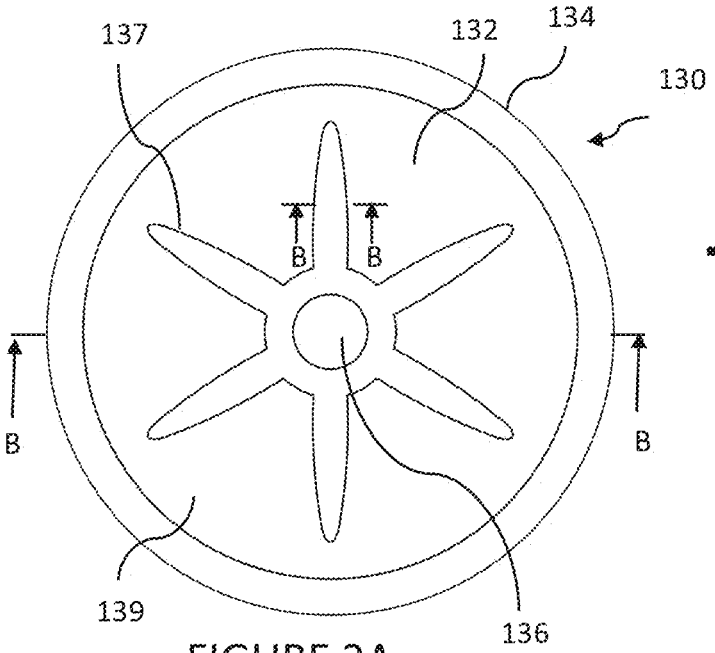
FIG. 2A shows a plan view of an urgable base according to a further embodiment of the presently disclosed subject matter, in an initial state.
Figure 2C:
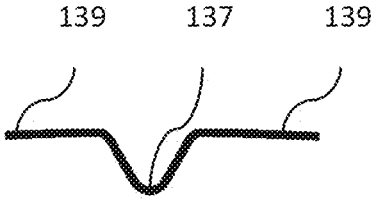
FIG. 2C shows a profile of the base of FIG. 2A in its partial cross-section taken along a plane C-C.
Figure 2B:
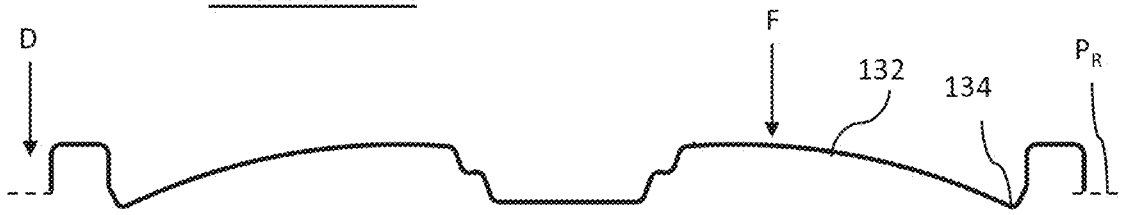
FIG. 2B shows a profile of the base of FIG. 2A, in its cross-section taken along a central plane of symmetry B-B.
Figure 2D:
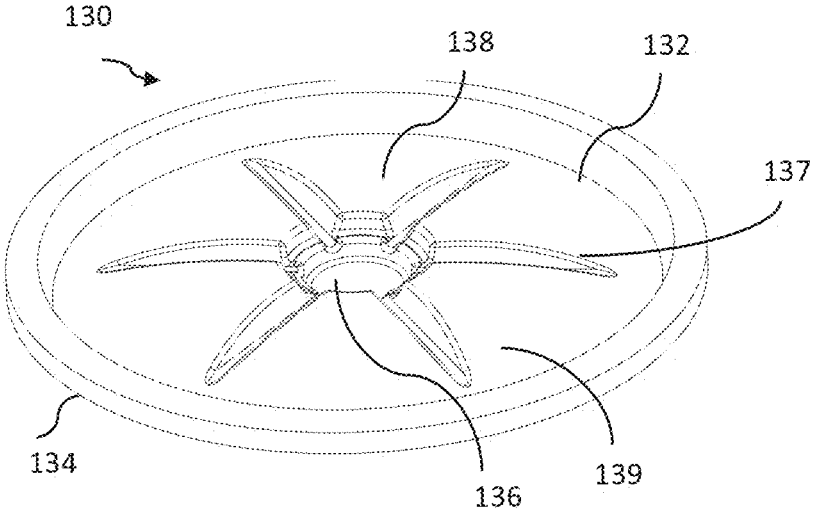
FIG. 2D shows in a top perspective view of the base of FIG. 2A.
Figure 2E:
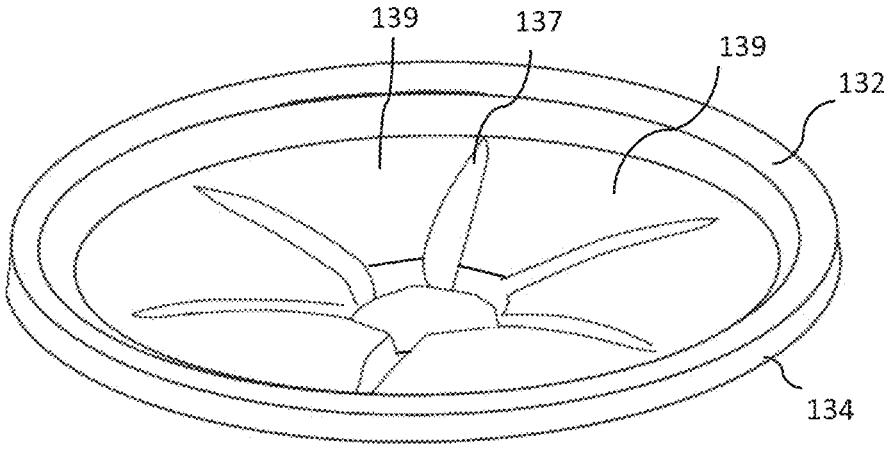
FIG. 2E shows a top perspective view of the base of FIG. 2A in a deformed state.

FIGS. 2A, 2D and 2E show a body 132 configured to be used as a base 130 of a can (not shown) and having a peripheral edge 134 along which the body 132 is to be fixed to a side wall of the can, a central area 136 and an intermediate area 138. The body 132 has a first side seen in FIGS. 2A and 2D, which is the side that is to face towards the exterior of the can, when the body 132 is mounted to the side wall of the can, and a second side opposite the first side.

The body 132 as seen at its first side, is formed with a plurality of channels or grooves 137, which are spaced apart from each other in the circumferential direction of the intermediate portion. The grooves 137 extend from the central area 136 towards the peripheral edge 134, and divide the intermediate area 138 into sections 139 each having the shape of an annular sector. Although six grooves 137 and correspondingly six sections 139 are shown, any other number is envisaged. From the second side of the body 132, the grooves 137 appear to be protrusions, since the body 132 of the base has a small through-thickness, such as is the norm with sheet metal or other laminates and/or canning materials.

Figure 2F:
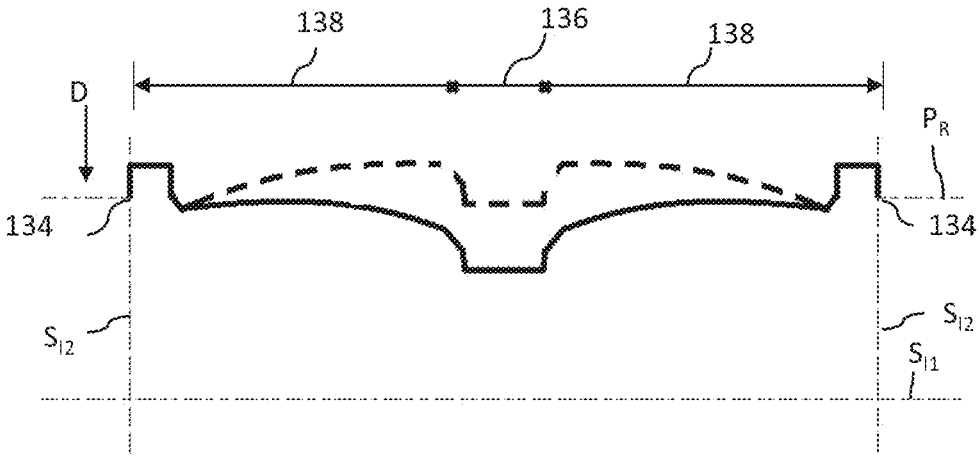
FIG. 2F is a schematic representation of the profile of the base of FIG. 2A in its cross-section referred to in the description of FIG. 2B, the profile being shown in a deformed state of the base in solid line and in an initial state of the base in dotted line.

FIG. 2F schematically illustrates the body 132 in its deformed state (shown in solid line) and initial state (shown in dotted line), and it is seen by a comparison of the initial state in FIG. 2D and the deformed state in FIG. 2E, as well as from the profiles of FIG. 2F, that the mutual orientation of each two adjacent sections 139 disposed on either side of each groove 137 changes between the two states. In particular, it is seen in the deformed configuration shown in FIG. 2G that when the body 132 changes its state to the deformed state, the two sections 139 on either side of each groove 137 are brought closer together, i.e. an angle between them or between planes tangential thereto changes.

Figure 3A:
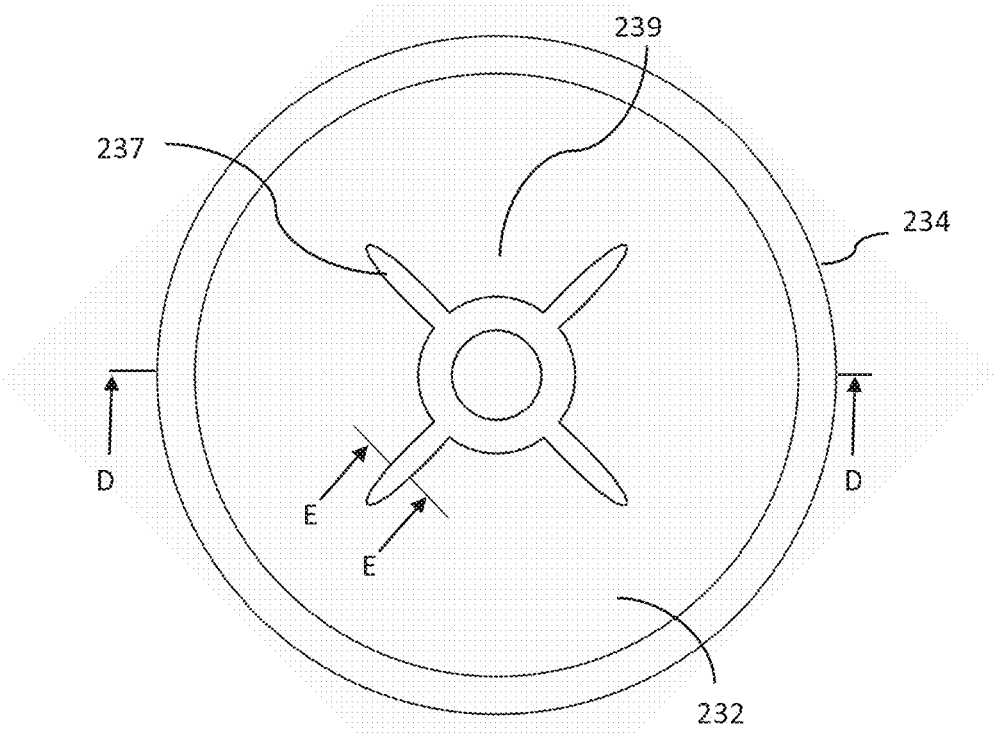
FIG. 3A shows in plan view an urgable base according to a further embodiment of the presently disclosed subject matter, in an initial state.
Figure 3B:
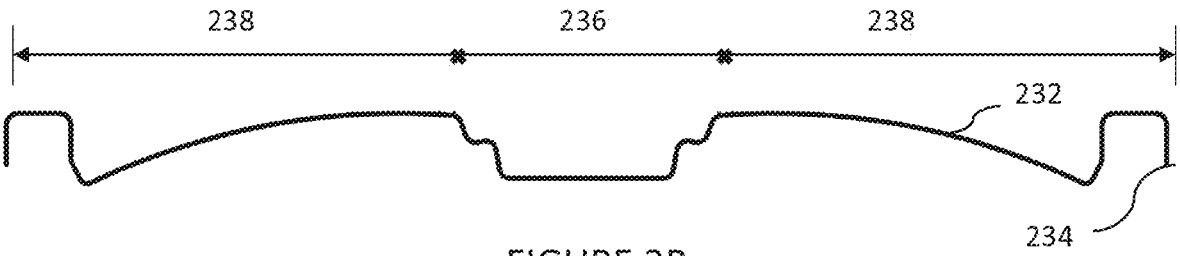
FIG. 3B shows a profile of the base of FIG. 3A, in its cross-section taken along a central plane of symmetry D-D.
Figure 3C:
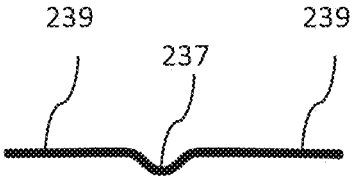
FIG. 3C shows a partial profile of the base of FIG. 3A, in its cross-section taken along a plane E-E.

FIGS. 3A, 3B and 3C show an alternative arrangement of a body 232, similar in almost all respects to the body 132, and having a peripheral edge 234, a central area 236, and an intermediate area 238 extending between the central area 236 and the peripheral edge 234. The body 232 differs from the body 132 in that there are only four grooves 237 and the intermediate area 238 is divided into four section 239. The grooves 237 extend from the central area 236 towards the peripheral edge 234 but do not extend as far as the grooves 137 extend from the central area 136 to the peripheral edge 134 of the base 130. The grooves 237 however provide the same functionality as the grooves 137 described in detail above with reference to the body 132.

Figure 4A:
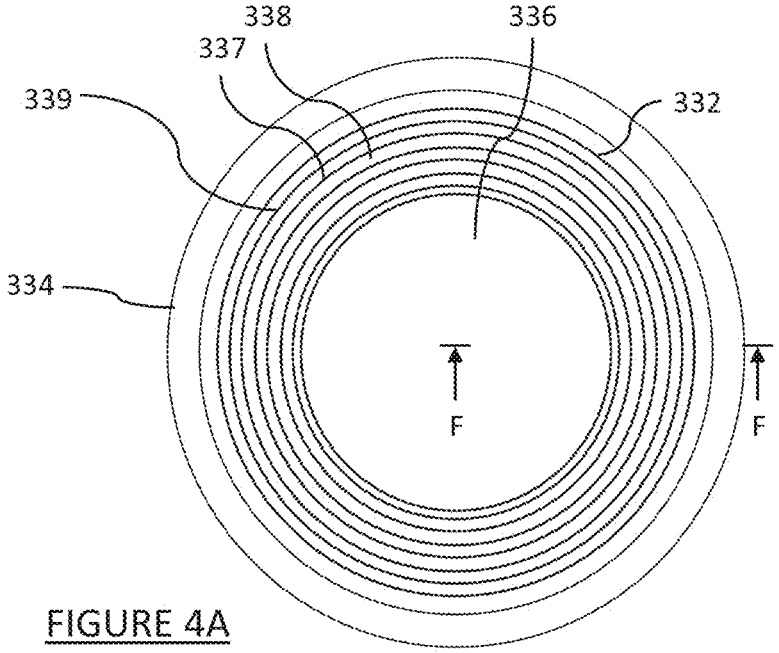
FIG. 4A shows in plan view of an urgable base according to a still further embodiment of the presently disclosed subject matter, in an initial state.
Figure 4C:
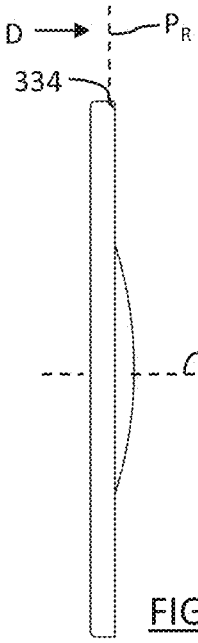
FIG. 4C shows a side view of the base of FIG. 4A.
Figure 4B:
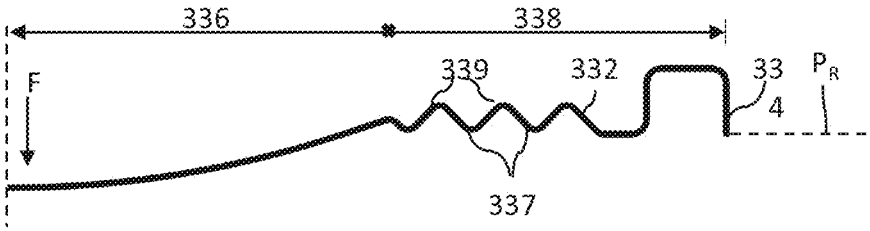
FIG. 4B shows a profile of the base of FIG. 4A, in its cross-section taken along a central plane of symmetry F-F.
Figure 4D:
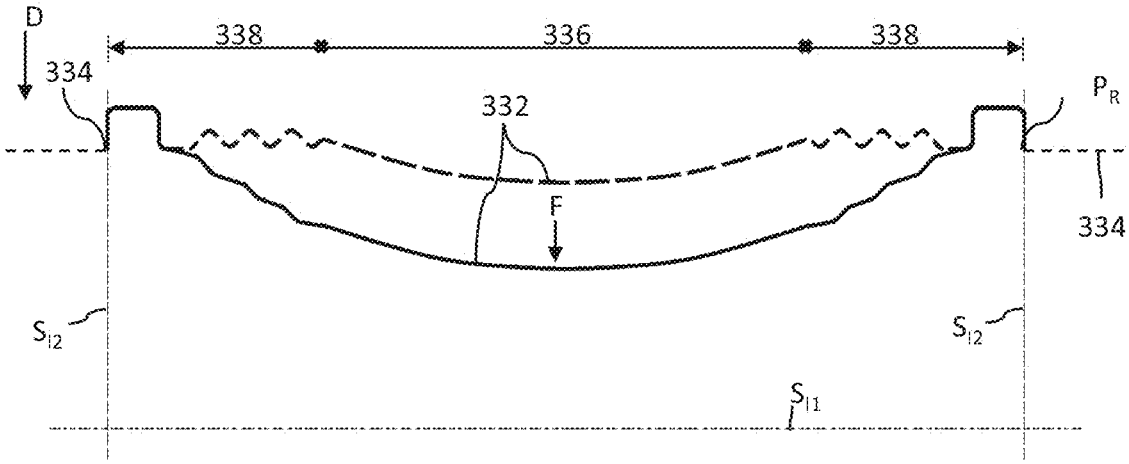
FIG. 4D is a schematic representation of the profile of the base of FIG. 4A in its profile in its cross-section referred to in the description of FIG. 4B, the profile being shown in a deformed state of the base in solid line and in an initial state of the base in dotted line.

FIGS. 4A-4C depict a body 332 having a peripheral edge 334, a central area 336 and an intermediate area 338 extending between the central area 336 and the peripheral edge 334. The intermediate area 338 comprises a ridged formation having a plurality of concentric consecutive peaks 339 and troughs or grooves 337 configured to change their radial extension relative to a central axis X of the body 332, when an urging force F greater than the threshold force $F_{Thresh}$ is applied to or adjacent the central area 336. More particularly, the ridged formation of peaks 339 and troughs 337 transforms into a series of concentric concave steps.

As shown in the initial and deformed states of the body 332 the central area 336 appears to have the same shape or configuration in both states of the body, i.e. remains undeformed, whereas the intermediate area 338 changes its shape or configuration, i.e. deforms, when moving from the initial state to the deformed state. The central area 336 is recessed relative to an adjacent portion of the intermediate area 338.

Figure 5A:
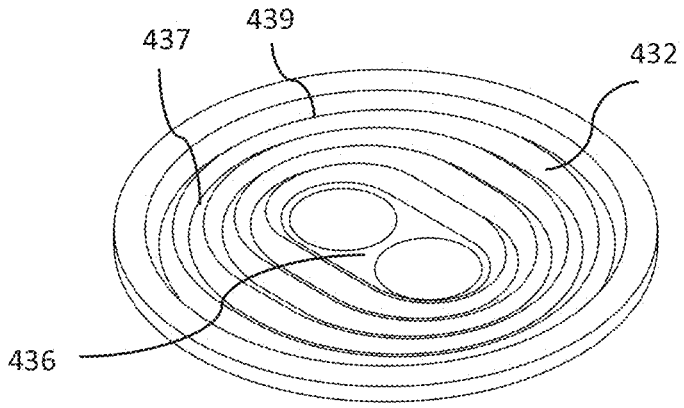
FIG. 5A shows a top perspective view of an urgable base of a still further embodiment of the presently disclosed subject matter, in an initial state.
Figure 5B:
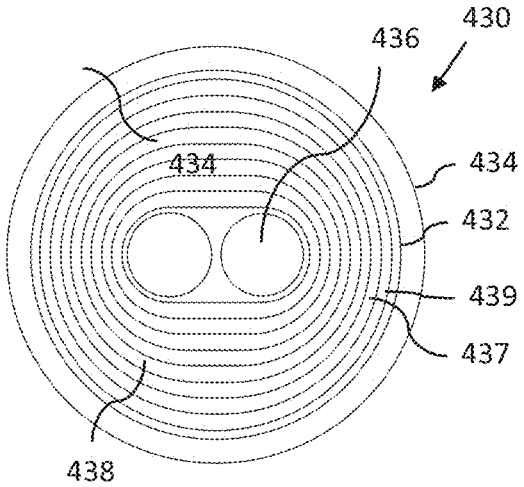
FIG. 5B shows a plan view of the base of FIG. 5A.
Figure 5C:
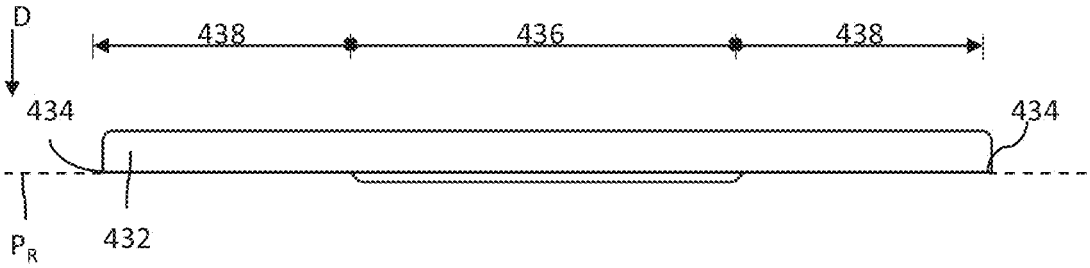
FIG. 5C shows a side view of the base of FIG. 5A.

FIGS. 5A-5C show a body 432 having a peripheral edge 434, a central area 436, and an intermediate area 438 extending between the central area 436 and the peripheral edge 434. The body 432 is similar to the body 332 described above in that its intermediate area 438 comprises a ridged formation having a plurality of concentric consecutive peaks 439 and troughs or grooves 437 surrounding the central area 436, which in the deformed state of the body 432 transforms into a series of concentric concave steps, i.e. steps recessed in the urging direction D.

The body 432 differs from the body 332 in that the central area 436 which is recessed in the urging direction D compared to the adjacent portion of the intermediate area 438, is flat and has an elongated shape having the shape of a rectangle with rounded shorter edges.

Although the above embodiments refer to the base of a can constituting an urging member deformable from an initial state to a deformed state such that the volume contained by the can reduces from an initial contained volume to a reduced contained volume, other possibilities for such volume reduction are envisaged.

A can having a deformable urging member as described above can be provided with a conventional lid or a lid having two opening arrangements, one —allowing removal of the liquid component while preventing removal of the solid component, and the other allowing subsequent removal of the solid component, the arrangements being spaced from each other by a separating portion of the lid preventing the passage of at least the solid component through this portion at least when the first and second opening arrangements are in operation.

The opening arrangements can be configured for being manipulated during operation of the lid either by producing at least one first opening for removing the liquid component and at least one second opening for removing the solid component, or by exposing such openings to the user, in which case the openings can be pre-existing, i.e. pre-fabricated in the lid and maintained unexposed until the operation of the lid. There can also be a combination of these two options in one lid, where one opening arrangement is designed in accordance with one of the options, and the other in accordance with the other option. In any case, at least in the initial state of the lid, the spacing between the two arrangements is provided by the separating portion at least in the direction perpendicular to a central axis of the can/lid. The, or each, first opening can be essentially smaller in width and length than the at least one second opening, which can be a single opening in the second opening arrangement. In general, the second opening can occupy at least 30% of the area of the lid, optionally at least 50% of the area of the lid, whilst the or each of the first openings can occupy a much smaller area of the lid. In general, without limitation, a smallest dimension across the second opening may be, for example, at least twice the smallest dimension of the first opening, optionally at least three times, optionally at least five times or optionally at least ten times the smallest dimension of the first opening.

Figure 6:
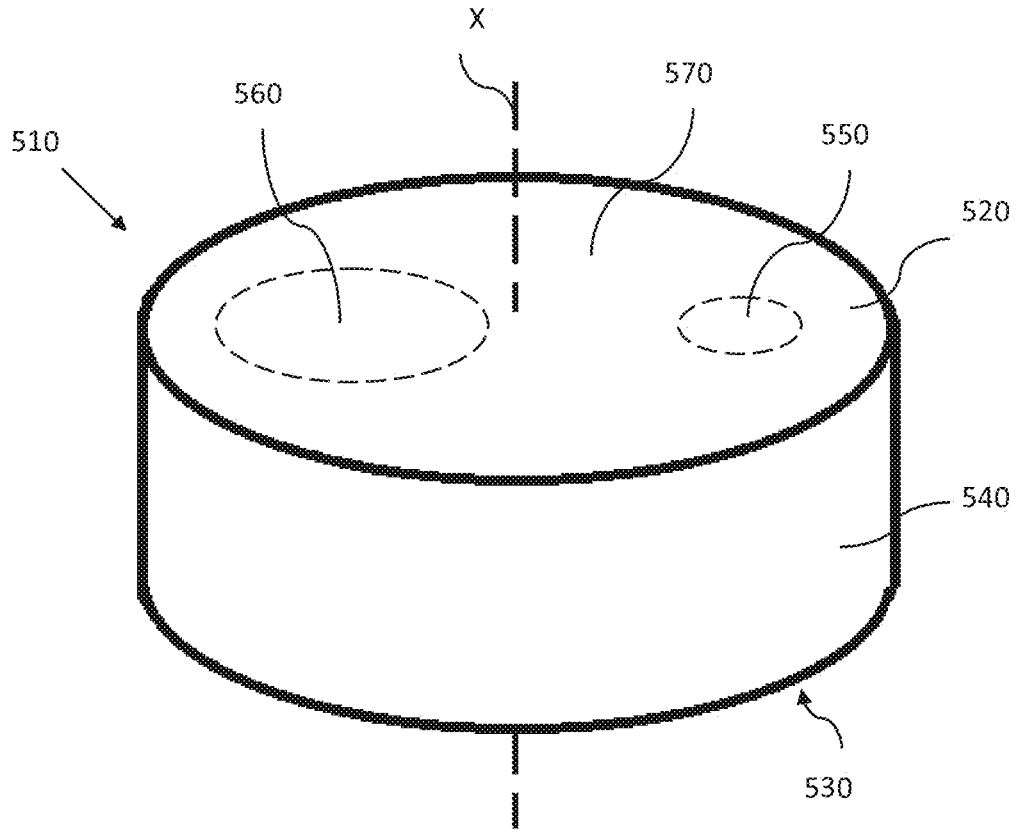
FIG. 6 shows a top perspective view of a can having first and second opening arrangements according to a still further embodiment of the presently disclosed subject matter.

FIG. 6 shows a can designated as 510, which is similar to the can 10 shown in FIGS. 1A and 1B, except for the design of its lid. Thus all the description provided above for the can 10, except for the description of the lid 20, is applicable to the can 510, which has a lid 520, a base 530 and a side wall 540 extending therebetween, as well as a central axis X passing through each of the lid 520 and the base 530.

The lid 520 of the can 510 has the described above first opening arrangement and second opening arrangement, represented schematically in FIG. 6 by a dotted line 550 and a dotted line 560, respectively, and the separating portion designated as 570.

Figure 7:
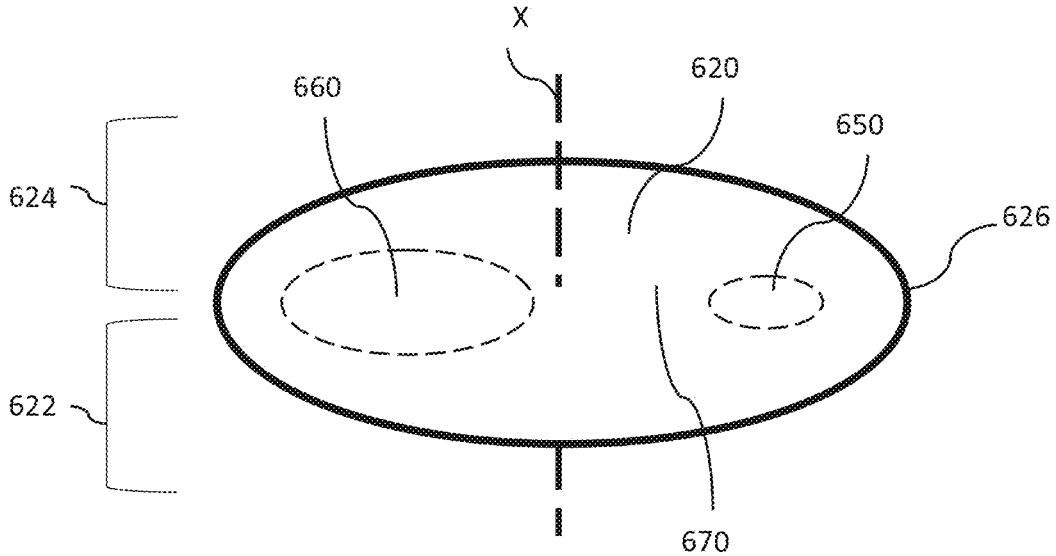
FIG. 7 shows a top perspective view of a lid for a can having first and second opening arrangements according to a still further embodiment of the presently disclosed subject matter.

The lid 520 can be formed as a unitary body at least with the side wall 540 and, optionally, with the base 530. Alternatively, it can be produced separately and attached to the side wall 540. FIG. 7 illustrates the latter option, where a lid 620 has two sides 622, 624, facing in different directions along the central axis X of the lid. The lid 620 has the described above first opening arrangement, second opening arrangement and separating portion therebetween. In FIG. 7, the first opening arrangement is represented schematically in by a dotted line 650, the second opening arrangement is represented schematically by a dotted line 660, and the separating portion therebetween is designated as 670. In this example, the first opening arrangement 650 is configured to allow transfer of the liquid component from one side of the lid 622, i.e. a first side, to the other side, or second side of the lid 624 while preventing transfer of the solid component together with the liquid component, the second opening arrangement is configured to allow transfer of the solid component from the first side 622 of the lid 620 to the second side 624 of the lid 620, and the separating portion 670 is configured to prevent the transfer of at least of the solid component at least when the first and second opening arrangements 650, 660 are in operation. The lid 620 also has a peripheral edge 626, along which the lid is configured to be mounted to the side wall 540 at an end of the side wall 540 opposite to an end associated with the base 530.

It should be indicated that the opening arrangements 550 and 560 of the lid 520 and 650 and 660 of the lid 620 shown in FIGS. 6 and 7 can include a number of components configured to be manipulated for producing first and second openings in the above lids or exposing them if pre-fabricated. Non-limiting examples of such options are presented below.

Figure 8A:
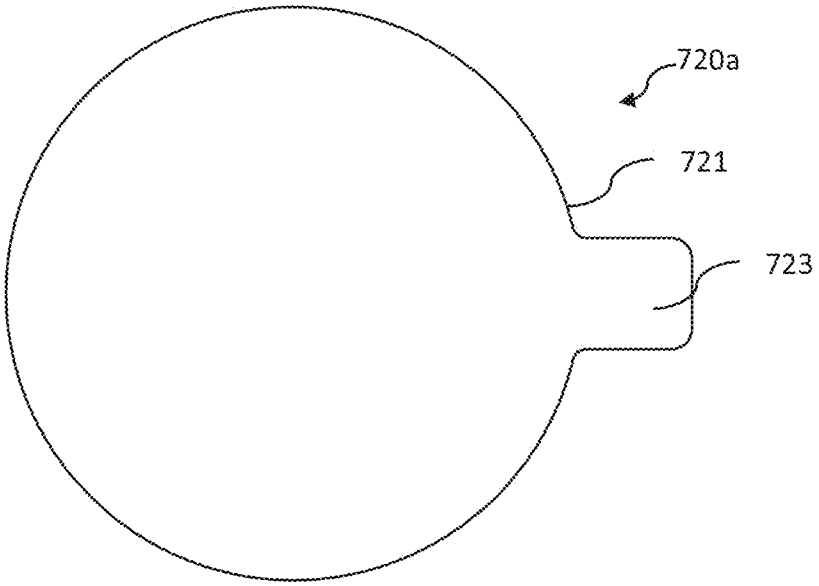
FIG. 8A shows a plan view of a covering layer of a lid for a can according to a still further embodiment of the presently disclosed subject matter.
Figure 8B:
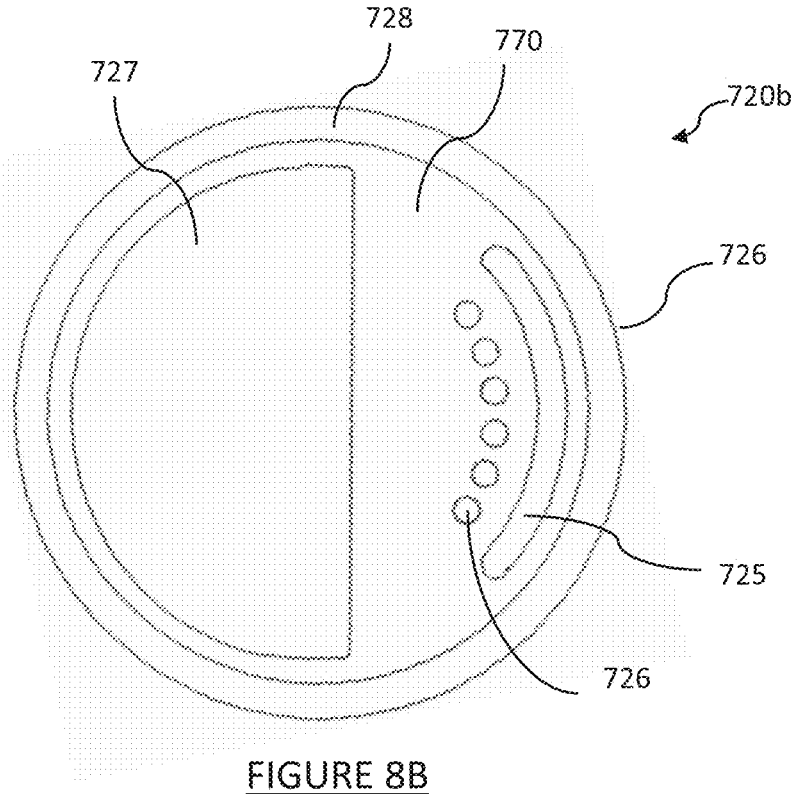
FIG. 8B shows a plan view of a strainer layer of a lid for a can.
Figure 8C:
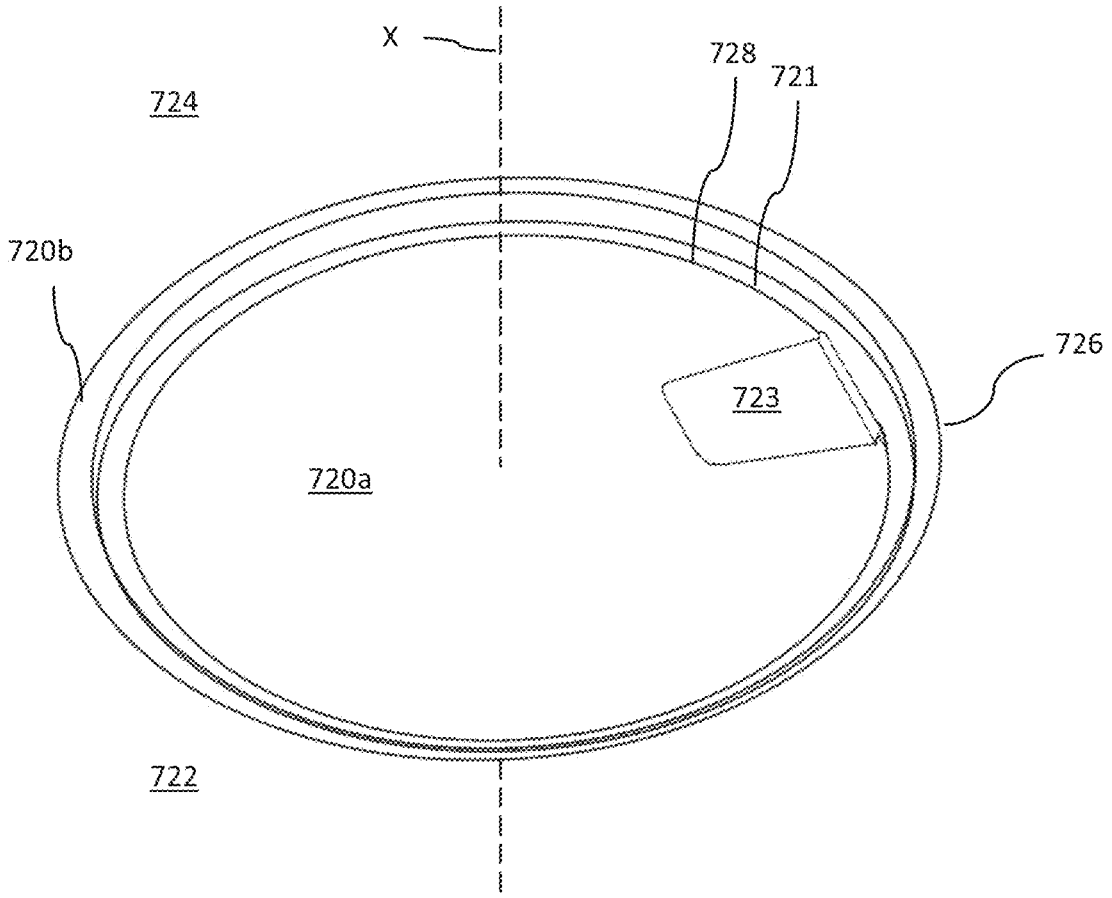
FIG. 8C shows a top perspective view of a lid comprising the covering layer of FIG. 8A and the strainer layer of FIG. 8B.

FIGS. 8A, 8B and 8C show a lid 720 which can be used in the can 510 instead of the lid 520 or 620, and which comprises two parts, namely a continuous covering layer 720*a* and a strainer layer 720*b* formed with the first and second openings mentioned above. The openings, which are pre-existing, or pre-fabricated, in the strainer layer are thus configured to be exposed for the removal of the liquid and solid components as described above, by manipulating with the covering layer 720*a*.

The covering layer 720*a* can be made of a sheet of metal foil or polymer film, or combination of any of these materials with any other materials. The strainer layer 720*b* can be made of the same material as the side wall 540, to which it is configured to be joined via a peripheral edge 726 of the strainer layer 720*b*. For example, the strainer layer can be formed of a rigid metal sheet material.

The strainer layer 720*b* comprises a support surface 728 proximal to the peripheral edge 726 of the lid. The support surface 728 is configured for adhering or otherwise securing an outer edge 721 of the covering layer 720*a* to the strainer layer 720*b*.

As shown, the lid 720 as a whole has two sides 722, 724, one of which, designated as 722, is an underside, or first side, of the strainer layer 720*b* and is configured to face toward an interior of the can when the lid 720 is mounted to the side wall of the can, and the other one, a second side, designated 724, is associated with an base outer side of the covering layer 720*a*. In this case, the first opening arrangement is constituted by those portions of the two layers which are configured for enabling passage of a liquid component from the first side 722 of the lid 720 to the second side 724 thereof while preventing passage of a solid component, while the second opening arrangement is constituted by those other portions of the two layers that are configured for enabling passage of a solid component from the first side 722 of the lid 720 to the second side 724 thereof. In the first and second arrangements, these portions of the strainer layer are those associated with the first and second openings mentioned above.

In general, the first and second openings in the strainer layer can have any configuration and be of any number allowing them to function as described above. In the example of FIGS. 8A to 8C, the openings in the strainer layer 720*b* are in the form of an elongated relatively narrow slit 725 constituting a part of the first opening arrangement, and a single large aperture 727 larger than the first aperture 725 in all its dimensions in the plan view of the lid, constituting a part of the second opening arrangement. In particular, the single large aperture 727 is wider than the elongated narrow slit 725, significantly and sufficiently so as to allow easy passage of the solid component therethrough.

In general, without limitation, a smallest dimension across the large aperture may be, for example, at least twice the width of the slit, at least three times the width of the slit, at least five times the width of the slit or at least ten times the width of the slit.

The slit 725 is for enabling passage of liquid component from the first side 722 of the lid 720 to the second side 724 thereof while preventing passage of a solid component, while the single large aperture 727 is for enabling passage of a solid component from the first side 722 of the lid 720 to the second side 724 thereof.

In the present example, the strainer layer 720*b* further comprises small apertures 729 which can be used instead or in addition to the slit 725 for enabling passage of a liquid component from the first side 722 of the lid 720 to the second side 724 thereof while preventing passage of a solid component. At least some of these small apertures can be used for enabling passage of a gas, such as the ambient air, from the second side 724 of the lid 720 to the first side 722 thereof. The slit 725 is spaced from the large aperture 727 and the small apertures 729 by a separating portion 770 of the lid 720 preventing the passage of the solid and liquid components through this portion 770.

In general, the covering layer 720*a* can be formed with any arrangement allowing at least one portion thereof to be grasped for pulling the covering layer away from the strainer layer for exposing the slit 725 and/or the small apertures 729 towards the outer-facing second side 724 of the lid and thereby operating the first opening arrangement and for subsequently exposing the large aperture 727 to the outer-facing second side 724 of the lid and thereby operating the second opening arrangement.

In the present example, the covering layer 720*a* comprises a pull tag 723 and this layer 720*a* is configured to be secured to the strainer layer 720*b* in such a manner that the pull tag 723 is disposed closer to the slit 725 than to the large aperture 727.

In general, the first and second openings of the first and second arrangements whether pre-fabricated or produced by the operation of these arrangements, can be disposed anywhere in the lid when seen in its plan view facing the lid's base outer side. However, the disposition of the first opening/s further from the center of the lid than that of the second opening/s and/or their spacing from one another to a maximal extent possible, allows transfer of the liquid component through the first openings with less chance of accidental transfer of liquid and/or solid from the second openings at the same time. Further, there is less likelihood that transfer of the liquid component via the first openings will soil any part of the second opening arrangement and/or the fingers of a user.

In the present example, the slit 725 and the large aperture 727 of the strainer layer 720*b* are positioned spaced from one another to a maximal extent, i.e. circumferentially spaced to a maximal distance from one another, and the pull tag 723 of the covering layer 720*a* is arranged to be positioned by the slit 725 and diametrically opposed from the large aperture 727, when the covering layer 720*a* is secured to the strainer layer 720*b*.

In operation, a user can pull the pull tag 723 to detach a first portion of the lid 720, namely a first part of the covering layer 720*a* from the remainder of the lid 720, i.e. from strainer layer 720*b* and thereby expose the pre-existing, or pre-fabricated slit 725 and possibly some or all of the pre-existing, or pre-fabricated small apertures 729. Such detachment can involve peeling of adhesive or tearing of the outer edge 721 of the covering layer 720*a*. In this case, at least in the initial state of the lid 720, the first part of the covering layer 720*a* together with at least the slit 725 and, optionally, the small apertures 729, can be considered to be a first opening arrangement.

With the first part of the covering layer 720*a* detached, a can having as its lid the lid 720 can be tipped to allow the liquid component inside the can to pass from the first side 722 to the second side 724 of the lid 720, such as under the force of gravity. Since the slit 725 has an arc-shaped relatively narrow elongated shape, the liquid component will flow out of its central area, and the ends of the slit can allow air to flow in the opposite direction if desired, in order to ensure equal pressure inside and outside the can if the contained volume of the can is not reduced as the liquid flows out. Alternatively or additionally, if the small apertures 729 are exposed by further detachment of the covering layer 720*a*, the liquid component can flow out of at least some/one of them, and/or air can flow in the opposite direction via at least the other/s if desired, in order to ensure equal pressure inside and outside the can if the contained volume of the can is not reduced as the liquid flows out.

Once the liquid component has been removed, a user can continue to pull the pull tag 723 to detach a second portion of the lid 720, namely a second part of the covering layer 720*a* from the remainder of the lid 720, i.e. from strainer layer 720*b* and thereby expose the pre-existing, or pre-fabricated large aperture 727. Such detachment can involve peeling of adhesive or tearing of the outer edge 721 of the covering layer 720*a*. In some cases, such detachment can result in removing the covering layer 720*a* entirely from the strainer layer 720*b*, while in other cases, at least a portion of the covering layer 720*a* can remain attached to the strainer layer 720*b*. At least in the initial state of the lid 710, the second part of the covering layer 720*a* together with the large aperture 727 can be considered to be a second opening arrangement spaced from the first opening arrangement at least by the separating portion 770. With the large aperture 727 exposed, the solid component can be removed from the can, i.e. transferred or passed from the first side 722 of the lid 720 to the second side 724 of the lid 720.

In the above arrangement only the single pull tab 723 is required to expose, in sequence with the extent of detaching of the lid 720, the first aperture 725 with the small optional apertures 729, followed by the second aperture 727.

Figure 9A:
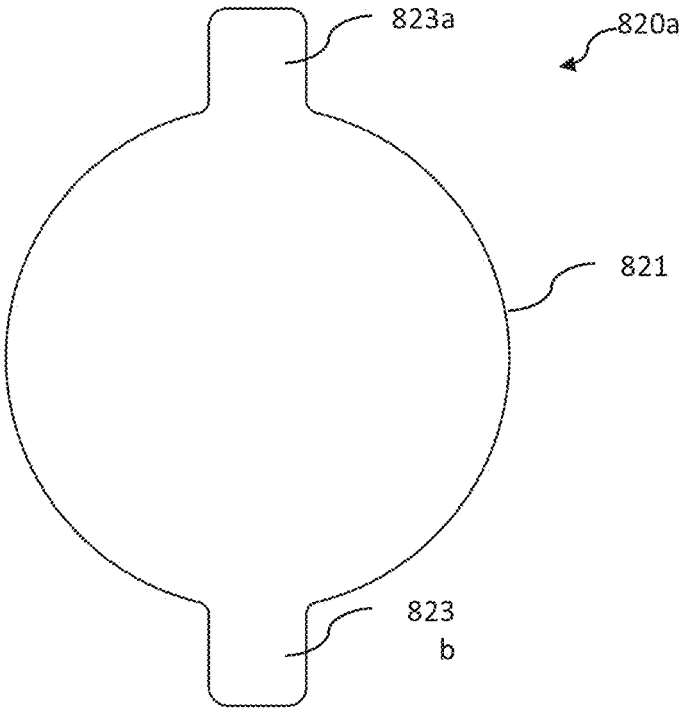
FIG. 9A shows a plan view of a covering layer of a lid for a can according to a still further embodiment of the presently disclosed subject matter.
Figure 9B:
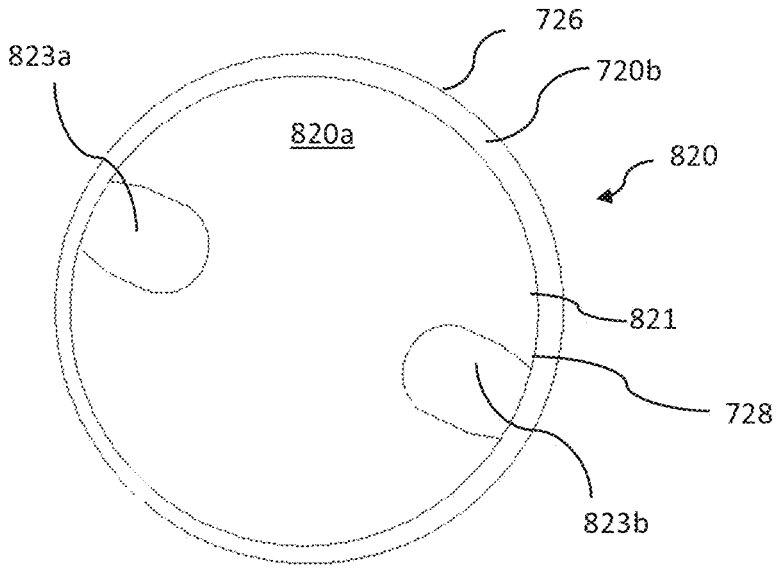
FIG. 9B shows a plan view of a lid comprising the covering layer of FIG. 9A and a strainer layer.

FIGS. 9A and 9B show a lid 820, which is similar to the lid 720 described above and which differs therefrom only in that its covering layer 820*a* has two pull tags, namely a first pull tag 823*a* and a second pull tag 823*b*, instead of the single pull tag 723.

In general, when such two pull tags are used, they can have any disposition corresponding to the disposition of the respective first and second openings, as long as they are spaced along the outer edge 821 of the covering layer 820*a*. In the present example, the first and second pull tags 823*a*, 823*b* are disposed diametrically opposed from one another, with the first pull tag 823*a* being closer to the slit 725 than to the large aperture 727, and the second pull tag 823*b* is closer to the large 727 than to the slit 725.

The operation of the lid 820 is the same as described above for the lid 720 except that use can first be made of the first pull tag 823*a* to detach a first portion of the lid 820 from the strainer layer 720*b* and thereby expose the slit 725 and possibly some of the small apertures 729 to the exterior of the lid at its outer side 724, and then of the second pull tag 823*b* to detach a second portion of the lid 820 from strainer layer 720*b* and thereby expose the large aperture 727 to the exterior of the lid at its outer side 724.

Since in the present example, there are two pull tags 823*a*, 823*b* which are spaced apart from one another, in this case being diametrically opposed, the second pull tag 823*b* will not accidentally become soiled by the liquid component when the can is tipped to remove the liquid component, even if the first pull tag 823*a* is accidentally soiled. In this way, a user can avoid getting their hands dirty in the process of draining the liquid component from the can and subsequently removing the solid component.

In general, another option is to provide a covering layer having at least one pull tag arranged to be capable of completely tearing off an associated portion of the covering the layer to expose at least one first pre-existing, or pre-fabricated aperture. Optionally, the torn off portion of the covering layer is less than a third of the area of the covering layer excluding the pull tags.

Figure 10:
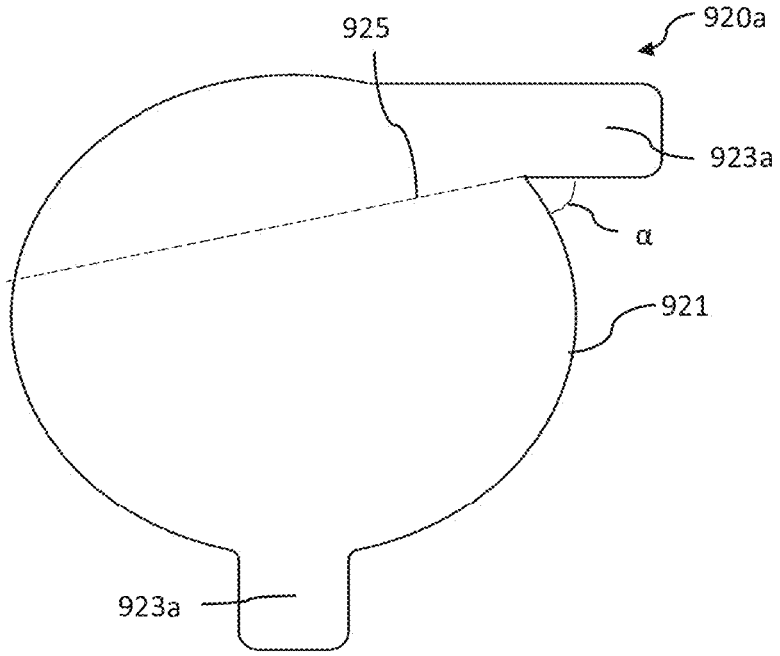
FIG. 10 shows a plan view of a covering layer of a lid for a can according to a still further embodiment of the presently disclosed subject matter.

FIG. 10 shows one example of such option in which a covering layer 920*a* is similar to the covering layer 820*a* described above and differs therefrom only in that in the covering layer 920*a*, the first pull tag 923*a* protrudes from an outer edge 921 of the covering layer 920*a* in a substantially tangential direction, i.e. transversely to a radially outward direction of the covering layer 920*a*. With this arrangement, an acute angle $\alpha$ is formed between the first pull tag 923*a* and the adjacent portion of the outer edge 921 of the covering layer 920*a*, due to which pulling of the first pull tag 923*a* applies a high stress at the vertex of angle $\alpha$, causing a portion of the covering layer 920*a* to tear off, e.g. approximately along the dashed line 925 shown in FIG. 10. Of course, this is possible when the covering layer is made of an easily torn material such as aluminum foil of a suitable thickness. The foil can further be provided with a configuration facilitating its tearing off such as e.g. grooves, semi-perforated lines, etc., which can be configured to provide one or more tears along lines other than the schematic line 925 shown in FIG. 10. The second pull tag 923*b* can be used subsequently to expose the second pre-existing, or pre-fabricated aperture.

One alternative design of a two-layer lid of the kind described above, which comprises a strainer layer with different pre-fabricated openings and a covering layer covering all of them, can be in that the covering layer is not a continuous layer extending along the entire area of the strainer layer but rather a number of individual layer portions each covering its own opening or a group of openings.

In another alternative design of a two-layer lid, instead of the strainer layer, the lid can have an inner layer in the form of a frame having a single large opening, a peripheral edge along which the lid is to merge with or be mounted to a side wall of a can, and a support surface extending therebetween for supporting the covering layer. In this case, the covering layer can be configured to be selectively detached from the support surface so as to expose, at the second side of the lid, different portions of the single pre-existing, or pre-fabricated opening spaced apart from each other by an area of the covering layer extending therebetween.

A still further alternative design of a lid according to the presently disclosed subject matter can be in that the lid has a first area with at least one first pre-fabricated opening covered by its individual covering layer, and a second area, in which at least one second opening can be produced by the detachment of at least a portion of the second area from the lid.

Some examples of the above alternative designs are described below.

Figure 11:
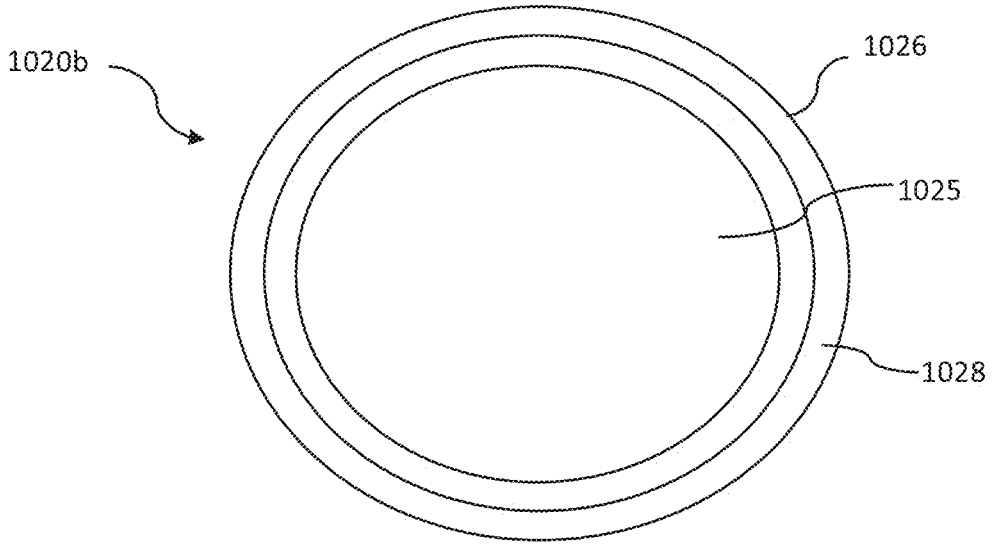
FIG. 11 shows a plan view of a ring layer of a lid for a can.

FIG. 11 shows a frame layer having the form of a ring 1020*b* comprising a peripheral edge 1026 for joining to a side wall of a can, a single large aperture 1025 occupying a majority of the area of the ring layer 1020*b*, and a support surface 1028 extending therebetween. With the ring layer 1020*b*, a lid can be formed by adhering or otherwise joining one of the covering layers 820*a* and 920*a* at its respective outer edge 821, 921 to the support surface 1028.

In order to operate the lid to allow drainage of liquid when the peripheral edge 1026 of the ring layer 1020*b* is joined to a side wall of a can comprising a liquid component and a solid component, one of the pull tags 823*a*, 823*b* or 923*a* of the respective covering layer 820*a*, 920*a* is pulled to detach or tear respectively a first portion of the respective lid, i.e. a first part of the respective covering layer at its respective outer edge 821, 921 from the support surface 1028 of the ring layer 1020*b*. The covering layer should be attached to the support surface 1028 so as to allow only a slight detachment of the covering layer 820*a*, or slight removal of the portion of the covering layer 920*a*, from the support surface so as to expose a portion of the aperture 1025 small enough to prevent passage of the solid component in the can but large enough to allow liquid to flow out of the can when tipped. The pull tag 823*a*, 823*b* or 923*a* together with the slightly detachable or removable portion of the covering layer 820*a*, 920*a*, and optionally with the respective, slightly exposable, portion of the aperture, can be considered to be a first opening arrangement.

In order to subsequently remove the solid component from the can, the other of the pull tags which were not previously pulled to detach the covering layer may be pulled to detach the respective covering layer at least along a majority of its outer edge to expose at least a majority of the pre-existing, or pre-fabricated aperture 1025. The solid component can then be removed from the exposed aperture. The exposed at least majority of the aperture, together with the other of the pull tags 823*a*, 823*b* or 923*b*, and the detached portion of the respective covering layer can be considered to be a second opening arrangement.

Figure 12A:
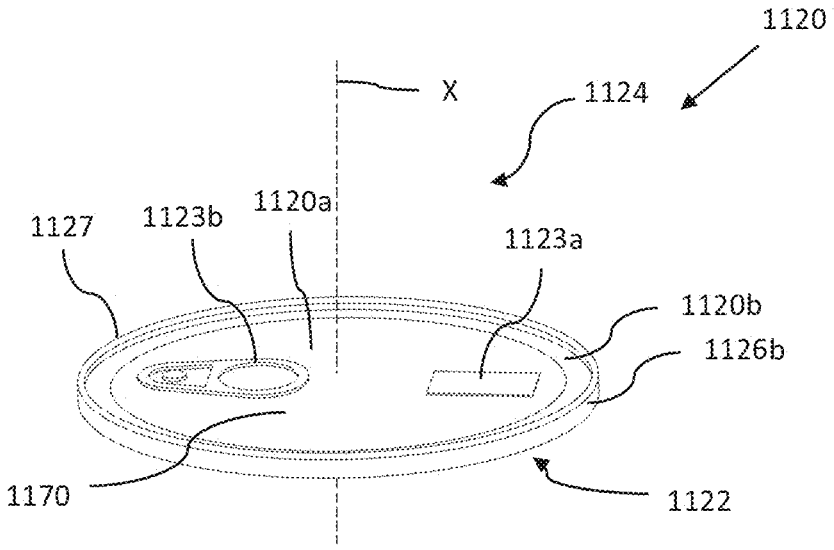
FIG. 12A shows a top perspective view of a lid for a can having first and second opening arrangements.

With reference to FIG. 12A, there is shown a lid 1120 comprising a central portion 1120*a* and a circumferential portion 1120*b* with a peripheral edge 1126 along which the lid is configured to be mounted, joined or otherwise attached to a side wall. The lid 1120 has two sides 1122, 1124, an inner side or first side 1122 configured to face toward an interior of a can and an outer side or second side 1224 configured to face towards an exterior of a can, when the lid is mounted to a side wall of a can.

The lid 1120 has a first opening arrangement comprising a tab 1123*a*, peelable from the remainder of the lid at its second side 1224, to expose a pre-existing, or pre-fabricated small first aperture pre-formed in the central portion 1120*a*. The peelable tab 1123*a* can be formed of metal or polymer for example, and may be adhered or otherwise joined to hermetically seal the first aperture. In operation of the first opening arrangement by at least partially removing the peelable tab 1123*a* to expose at least a part of the first aperture, the first opening arrangement allows transfer of the liquid component from the first side of the lid 1122 to the second side of the lid 1124 while preventing removal of the solid component together with the liquid component.

The lid 1120 also has a second opening arrangement comprising, in the initial state of the lid, a ring pull 1123*b* attached to the central portion 1120*a*, and a scored or semi-perforated groove 1127 surrounding at least a majority of the central portion 1120*a*, between the central portion 1120*a* and the circumferential portion 1120*b*. In operation of the second opening arrangement, the ring pull 1123*b* is operated to tear the lid 1120 along at least a majority of the groove 1127, such that at least a majority of the central portion 1120*a* of the lid 1120 is separated and detached from the remainder of the lid, i.e. from the circumferential portion thereof, to provide a single large aperture occupying a majority of the area of the lid 1120. The exposure of the single large aperture, i.e. the second aperture, is configured to allow removal of the solid component from the first side 1122 of the lid 1120 to the second side 1124 of the lid 1120. In the initial state of the lid 1120, the second opening arrangement is spaced from the first opening arrangement by a portion 1170 of the lid 1120 preventing the passage of the solid component and the liquid component through this portion 1170.

Figure 12B:
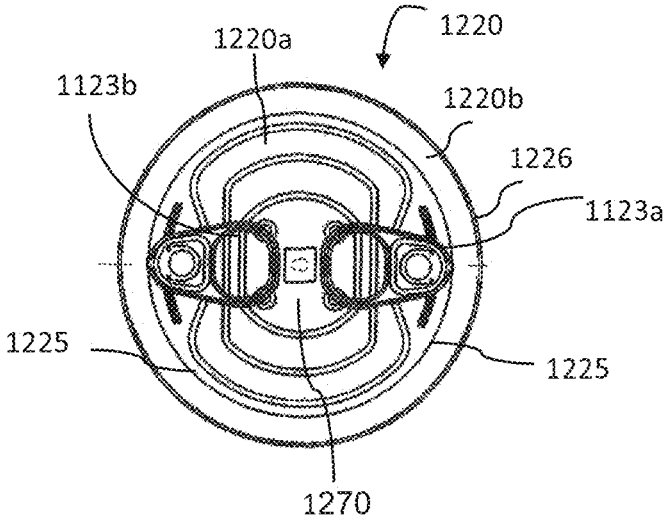
FIGS. 12B and 12C show a plan view of a lid for a can having first and second opening arrangements.
Figure 12C:
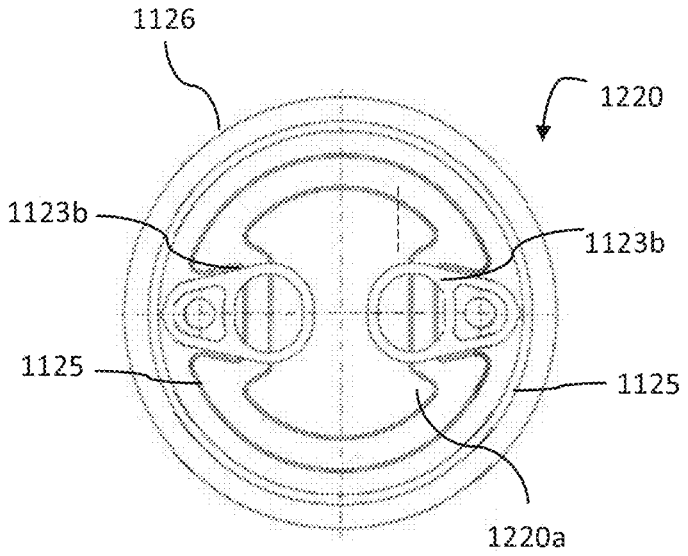

FIGS. 12B and 12C show an alternative arrangement for a lid 1220. Lid 1220 comprises a central portion 1220*a* and a circumferential portion 1220*b*. The circumferential portion 1220*b* comprises a peripheral edge 1226 along which the lid is configured to be mounted, joined or otherwise attached to a side wall of a can at an end of the side wall opposite to that at which a base is configured to be connected to the side wall. The lid 1220 has two sides one of which is configured to face toward an interior of the can when the lid is mounted to the side wall of the can.

In general, a lid may comprise two separate scored or semi-perforated grooves surrounding at least a part of the central portion of the lid, each arranged to be opened by a separate opening arrangement such as ring pulls. One groove may be shorter than the other, so as to provide a smaller opening once torn or cut along. Alternatively, there may be a single groove, openable by tearing or cutting in two spaced-apart locations by two separate opening mechanisms, such as two separate ring pulls.

In this example, the lid 1220 has a first opening arrangement comprising a first ring pull 1223*a* arranged at a first location next to a scored or semi-perforated single groove 1225 surrounding the central portion 1220*a* of the lid 1220. The lid 1220 also has a second opening arrangement comprising a second ring pull 1223*b* arranged next to the scored or semi-perforated single groove 1225, at a second location spaced from the first location. In the initial state of the lid, the second opening arrangement is spaced from the first opening arrangement by a portion 1270 of the central portion 1220*a* of the lid 1220 preventing the passage of the solid and liquid components through this portion 1270. The spacing is in a plane perpendicular to the central axis X. Each of the opening arrangements, i.e. ring pulls 1223*a*, 1223*b* is associated with its own portion of the groove 1225.

In operation of the first opening arrangement, the first ring pull 1223*a* is operated to tear the lid 1220, i.e. to tear and detach the central portion 1220*a* of the lid 1220 from the remainder of the lid, i.e. from the circumferential portion 1220*b* along a part of the groove 1225 associated with the first ring pull 1223*a*, to provide a first aperture small enough to prevent passage of the solid component in the can but large enough to allow liquid component to flow out of the can when tipped. The provided first aperture can be considered to be a part of the first opening arrangement, i.e. together with the first ring pull 1223*a*.

In operation of the second opening arrangement, the second ring pull 1223*b* is operated to tear the lid 1220, i.e. to tear and detach the central portion 1220*a* of the lid 1220 from the remainder of the lid, i.e. from the circumferential portion 1220*b* along at least a majority of the part of the groove 1225 associated with the second ring pull 1223*b*, to provide a second aperture large enough to allow passage of the solid component from the can, i.e. to allow removal of the solid component from the first side of the lid 1220 to the second side of the lid 1220. The provided second aperture can be considered to be a part of the second opening arrangement, i.e. together with the second ring pull 1223*b*.

In some arrangements, the lid is configured so that the portion of the lid which is detachable during operation of the first opening arrangement is smaller than the portion of the lid which is detachable during operation of the second opening arrangement.

In at least some of the above embodiments, the first opening arrangement may allow passage of air therethrough while in operation and when liquid is being removed, if desired.

Figure 13:
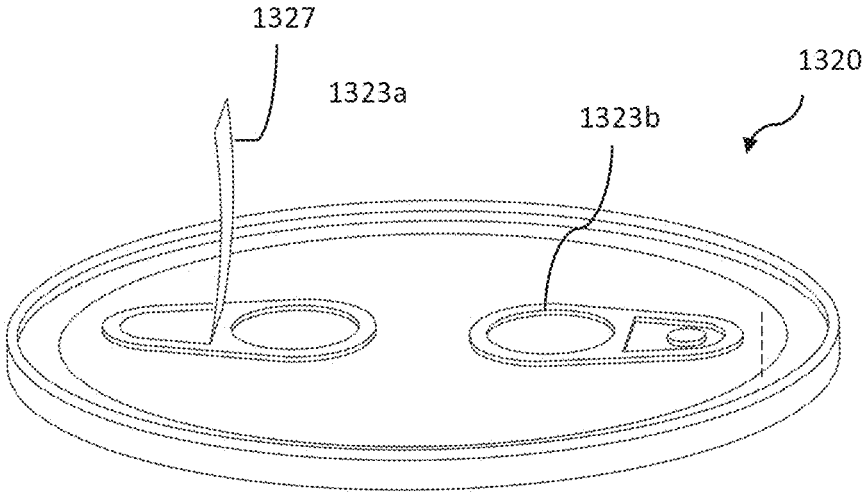
FIG. 13 shows a schematic top perspective view of a lid having a direction control component according to a still further embodiment of the presently disclosed subject matter.

In any of the above arrangements, there may be provided, adhered or otherwise joined to at least a portion of the lid proximate to the first opening arrangement, a direction control component, such as an elongate tongue arranged to provide a flow-path for liquid being removed from the can. This elongate tongue can control and direct the flow of the liquid component, so as to avoid accidental soiling of other portions of the lid by the liquid component. Subsequent to use, the elongate tongue may be detachable from the lid, such as by tearing or peeling off, prior or subsequent to operating the second opening arrangement. FIG. 13 illustrates one example of a lid 1320 having two ring-pulls 1323*a*, 1323*b*. Attached to one of the ring pulls 1323*a* is an elongate tongue 1327.

In any of the above arrangements, the deformation of the urging member from the initial state to the deformed state can be plastic deformation. In such cases, by applying urging force which exceeds a pre-determined threshold, the state of the urging member is changed from the initial state thereof to the deformed state thereof and is maintained in this state after the urging force is released, i.e. no longer applied. Alternatively, the deformation of the urging member from the initial state to the deformed state can be elastic deformation. In such cases, after the urging member is deformed to the deformed state by the urging force applied thereto by the user, and the urging force is released, the urging member can urge back into its initial state. Moreover, the urging member can be configured to be repeatedly elastically deformed in this manner, while returning each time to its initial state or to a state closer to the initial state than to the deformed state.

In general, can be configured so as to have elastic properties suitable for it to operate in the above elastic manner under the repeated application and release of the urging force F.

In this case, the urging member should be configured so that the urging force F, under which the urging member can have properties suitable for its above elastic operation, will meet the following condition $F_{plastic}>F>F_{Thresh}$, in which $F_{plastic}$ is a pre-determined threshold at which the material would undergo plastic deformation preventing its return into the initial position or close thereto; and $F_{Thresh}$ is, as described above, an urging force at which the urging member can not yet be deformed to a desired extent.

To be able to repeatedly undergo the above elastic deformation, the urging member can have corresponding elastic properties and, in its cross-sectional view, a convex shape in the initial state, whilst being less convex or planar or concave in the elastically deformed state.

When constituting a base in a can in a ready-for-sale state, being hermetically sealed by an openable lid, the urging member can be configured to be operated in the above elastic manner at least when the lid is at least partially opened.

In operation of such elastic urging member in a can of any of the above examples, after a portion of the lid was opened (as aforementioned) and after the user ceases to apply urging force on the elastic urging member, the elastic properties thereof will urge the elastic urging member back into its initial state, due to which the contained volume of the can will increase relative to its volume with the urging member in its deformed state.

The urging member can be in the form of a thin plate made of metal such as steel, aluminum, tin and the like, having a convex shape and such dimensions as to be capable to be repeatedly elastically bent upon the application of the urging force at its central area, and to return back each time when the force is released.

When such metal plate constitutes a base of a can containing a product having a liquid and a solid component, after having a lid with a portion thereof being suitably opened, by repeatedly urging the plate, more and more of the liquid component can be pumped out from the can through the opened portion of the lid, and be replaced by air sucked into the can when the plate returns back from its deformed state, rendering the operation of the plate to be similar to that of a membrane in a dozing pump. Such operation can result in the liquid component being gradually and controllably removed from the can.

When the product is a consumer food product, the metal plate can be configured to be elastically bent at an urging force F which can be routinely applied to the base by a finger/s of an average consumer to easily deform the base as desired. For example, such force can be about 20 N (or 2 Kg of force).

The above metal plate can have any desired configuration in a plan view thereof, conforming to that of a can where the urging member is to be used as a base, e.g. it can have such regular shape as round, oval, square or rectangular.

The metal plate can be in the form of a tin-coated or chrome-coated steel plate with a temper in the range from TS275 to TH620 according to European standard EN 10202: 2001, or of similar temper according to other corresponding standards, and having a thickness in the range from 0.16 mm to 0.21 mm.

The metal plate can have a ratio between its thickness and maximal dimension in the plan view in the range of 0.001-0.005, more particularly, between 0.002 and 0.003. Such plate can have a maximal deformation distance between the locations of its center point in the initial and maximally elastically bent state in the range of 5 to 10 mm and more particularly in the range of 6-8 mm.

One specific example of a can having a base in the form of a metal plate is a round tuna can having a base of a standard thickness of 0.16 mm and diameter of 80 mm. The base of the can can be made of tin-coated steel plate of one of the above types and having a convex shape in the initial state and elastically bendable inwardly into a substantially planar (or at least more planar than convex) shape upon the application of an urging force of about 20 N at its central area. Its convexity in the initial state can be such that the maximal deformation distance between the two states can be about 7 mm.

Figure 14A:
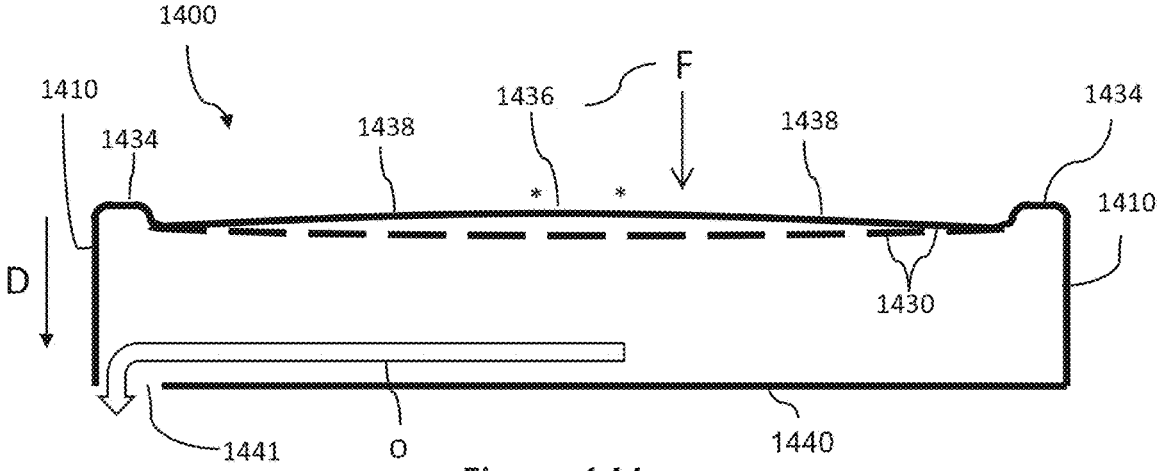
FIG. 14A is a schematic representation of a profile of an elastic urging member, according to a further embodiment of the presently disclosed subject matter, in an initial state, in a cross-sectional view of the base member taken along its central plane of symmetry.
Figure 14B:
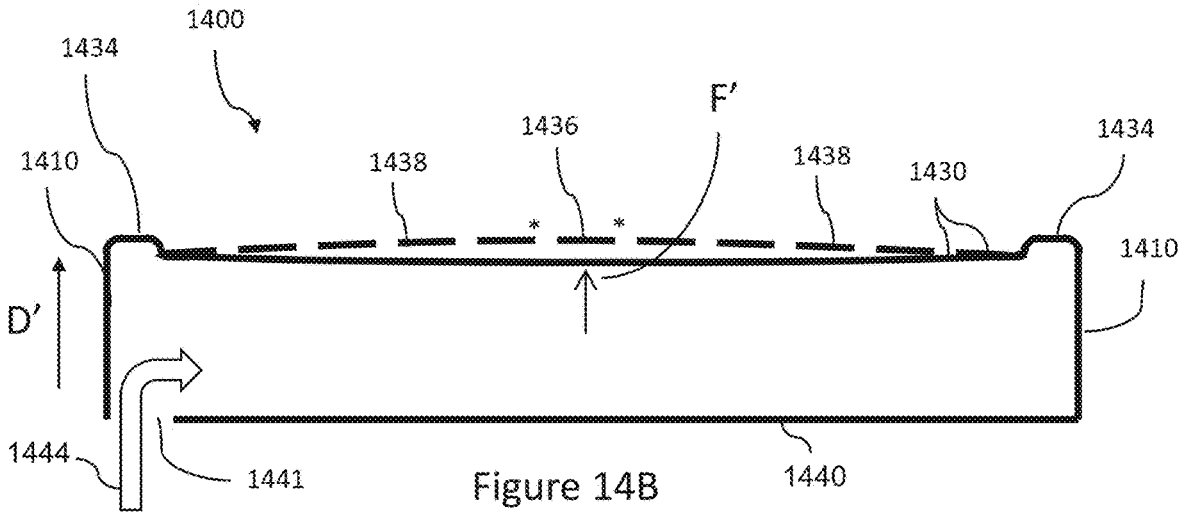
FIG. 14B shows the profile of the elastic urging member of FIG. 14A, in a deformed state.

FIGS. 14A and 14B illustrate one example of a metal constituting a base 1430 of a can 1400, and having a peripheral edge 1434 at which the base 1430 is connected to a side wall 1410 of the can 1400, a central area 1436 and an intermediate area 1438 therebetween.

It should be understood that the particular shape of the base 1430 in its initial and deformed states shown in FIGS. 14A and 14B are merely exemplary, and other possibilities are envisaged. For example, without limitation, the base 1430 can have an initial convex or planar configuration in the initial state and, respectively, a less convex or planar, or concave configuration in the deformed state.

FIG. 14A schematically illustrates a metal can 1400 for a food product, such as e.g. a tuna can, with the base 1430 connected to the side wall 1410 of the can adjacent its peripheral edge 1434. The metal can 1400 having a lid 1440, the lid 1440 being slightly opened, in any conventional manner or any manner described in the previous examples, to provide an opened portion 1441. The opened portion 1441 is configured with a size sufficient for a liquid component of the product (e.g. oil), but insufficient for a solid component of the product (e.g. tuna chunks), to pass therethrough. As seen, the can 1400 is held in a turned-on position with its base 1430 facing upwardly and its lid 1440 facing downwardly.

The base 1430 has a convex shape in its initial state (shown in solid line in FIG. 14A). As seen in FIG. 14A, in the present example in spite of being convex, the base does not protrude outwardly from the peripheral edge of the can, to allow conventional packaging thereof.

The can 1400 is shown in FIG. 14A with an urging force F applied to its central area 1436 for bending the base 1430 inwardly from its initial, convex shape towards its deformed, planar state (shown in dashed line in FIG. 14A). In order to prevent plastic deformation of the body, the urging force F applied on the base 1430 should be lower than $F_{plastic}$ of the base 1430. During the elastic deformation, the contained volume of the can 1400 will decrease relative to its volume with the urging member in its initial state, and as such liquid component is forced out of the can 1400 through the opened portion 1441 in the lid 1440 in the direction of arrow O.

FIG. 14B schematically illustrates the can 1400 of FIG. 14A with the base 1430 in its deformed state (shown in solid line), when the urging force F has been released, and a return-back force F' developed in the base 1430 in a direction D' opposite to the direction D, due to strains and stresses created therein when it was bent inwardly, causing the base to return back towards the initial state thereof (shown in dashed line in FIG. 14B). At this time, the contained volume of the can will increase relative to its volume with the urging member in its deformed state, and air will be forced into the can 1400 through an opened portion 1441 in the lid 1440 in the direction of arrow I.

Repeatedly urging the base 1430 inwardly by applying the force F and releasing this force to allow the base 1430 to be deformed and return back to its non-deformed state or to a state close to its non-deformed state, will cause more and more of the liquid component to be removed from the can 1400 out of the opened portion 1441 of the lid 1440, and will be replaced by air sucked into the can 1400 by the returned movement of the base 1430. Once no more liquid component is forced out of the opened portion 1441 of the lid 1440, the can 1400 can be turned over and the lid 1440 can be further opened to remove the solid component.

As mentioned in the description above, an urging member configured to constitute a base for a can, according to the presently disclosed subject matter, has a peripheral edge along which it can be unitarily formed with a can side wall, or can be fixedly mountable to a can side wall at one end of the can side wall. The can side wall with the base connected thereto thus constitutes a semi-fabricated can, in which the can side wall end opposite to the end to which the base is connected is open for filling therethrough the can with contents and for being subsequently hermetically sealed by an openable lid, to take the form which the can has when it is in the ready-for-sale state.

In the description hereinabove and hereinbelow and the claims, the terms 'urging member' and 'can base' or 'base of the can' are used interchangeably, and unless indicated otherwise, the description referring to one of them is fully applicable to the other one. In other words, the urging member and the can base have one and the same body, with the only difference being that the term 'urging member' is normally used when this body is described per se, i.e. in isolation from the can side wall, and the terms 'can base' or 'base of the can' are normally used when the body is described when it constitutes a part of the semi-fabricated can or the ready-for-sale can.

As also mentioned above, an urging member of the presently disclosed subject matter has a first side which is the side that is to face towards the exterior of the can and a second side opposite the first side and configured to face the interior of the can, when the urging member constitutes the can base and is connected to the can side wall. In the description hereinbelow and the claims the first side will be referred to as an outer side of the urging member or the base and the second side will be referred to an inner side of the urging member. The inner side can thus be considered as defining an inward direction of the urging member and the outer side can be considered as defining an outward direction of the urging member.

An urging member of the presently disclosed subject matter can have a central axis and an urgeable area that can comprise at least a central portion of the urging member that surrounds the central axis and comprises or is bounded by urgeability-providing elements for allowing the urgeable area to be repeatedly elastically displaced for pumping liquid out of the can as described above.

The urgeable area can thus have a normal state, in which at least a part of the central portion is convexly curved outwardly towards the central axis and in which a normally-outermost surface of the urgeable area is disposed at a location spaced from the reference plane defined by the peripheral edge of the urging member, to a first distance, and the urgeable area can be brought to an elastically deformed state, in which the normally-outermost surface of the urgeable area is no longer outermost, and is disposed at a location spaced from the reference plane to second distance greater than the first distance. Optionally, the urgeable area's normally-outermost surface can have a circular perimeter centered about the central axis, and can be planar and parallel to the reference plane in both the normal and deformed states of the urgeable area.

The urgeability-providing elements mentioned above, can be in the form of a pattern of ribs/ridges and/or grooves/recesses on the outer side of the urging member, designed so that the urgeable area can be repeatably elastically displaceable from the normal state to the deformed state to allow the above described pumping of liquid out of the can by the manual application and release of an inwardly directed urging force at the urgeable area, by finger/s of a user. The pattern can be designed to maintain the urgeable area's ability to undergo the above repeated elastic deformation for a predetermined minimum number of times (pumpings). This number can be more than 10, more particularly, more than 20, still more particularly, more than 30, and still more particularly, at least 50. Furthermore, since a thermal process which a can with contents hermetically closed by a lid attached to the can side wall at an end opposite to that with the base, needs to undergo for pasteurization and/or sterilization of these contents, subject the base of the can to high pressures, which are likely to move the urgeable area from its normal state to its deformed state, the above pattern can be designed to ensure that the urgeable area can independently return to the normal state after such process.

The above pattern should thus be designed so as, on the one hand, to provide in the urging member sufficient area about the central axis which is free of any strengthening elements, so as to constitute at least a part of the above mentioned elastically displaceable urgeable area and, on the other hand, to provide strengthening elements at least partially bounding the urgeable area to ensure that this urgeable area will return to its normal state after the above mentioned thermal process/es and repeatedly return to its normal state after each of the predetermined number of repeated elastic deformations caused by the manual application of the urging force needed for the pumping.

Designing such a pattern can involve a trial-and-error process in which at least the following considerations can be suggested: fully bounding the urgeble area by strengthening elements might necessitate an increased force to be applied for bringing this area into the deformed state, i.e. a force higher than that which can be easily manually applied by at least one finger of a user as needed for the above described pumping; this means that, to reach the desired behaviour of the urgeable area, the strengthening elements bounding it must necessarily be spaced from each other, and their shape, dimensions and spacing between them should be selected so as, on the one hand, to allow the urgeable area to be easily elastically displaced from the normal state to the deformed state by the above manually applicable force, and on the other hand to function as stress concentration elements causing the urgeable area to to return to its normal state upon release of the urging force.

One example of urgeability-providing elements meeting the above considerations is a number of urgeable-area bounding elements disposed closer to the central axis than an at least one peripheral strengthening element located closer to the peripheral edge of the urging member and defining boundaries of the urgeable area. Such urgeable-area bounding elements can include strengthening bounding elements and free bounding portions that are free of any strengthening elements, such as e.g. spacings between the strengthening bounding elements. In this case, at least a majority of the urgeable area and regions extending between the free bounding portions and the at least one peripheral strengthening element, can also be free of any strengthening elements.

The at least one strengthening bounding element can be spaced from the reference plane of the urging member to a distance that is at least not greater, optionally, smaller than that of the at least one peripheral strengthening element. The at least one peripheral strengthening element and the at least one strengthening bounding element can have different cross-sectional shapes and dimensions.

Both the peripheral strengthening element/s and the strengthening bounding elements can be in the form of ribs or beads having different geometry, e.g. different width at their tops and/or bottoms and/or different slopes of their side surfaces between the tops and the bottoms.

The at least one peripheral strengthening rib located adjacent the peripheral edge of the urging member can extend along at least a majority of the length thereof. The at least one peripheral strengthening rib can have a continuous shape and can extend along the entire length of the peripheral edge of the urging member. The at least one peripheral strengthening rib will be hereinafter referred to as at least one static strengthening bead. The at least one static strengthening bead can be spaced from the peripheral edge of the urging member by a static recess.

The strengthening bounding ribs can be circumferentially spaced apart and located closer to the central axis of the urging member than the at least one static strengthening bead and equally spaced from the central axis so as to define a central portion of the urging member which constitutes at least a portion of the urgeable area. These circumferentially spaced apart ribs defining the central portion of the urging member will hereinafter be referred to as dynamic strengthening beads. The terms 'static' and 'dynamic' in the description of the strengthening beads are intended to indicate that the dynamic strengthening beads are located in the immediate vicinity of the movement of the urgeable area when its state changes from the normal to the deformed state, so that the above movement might even cause the dynamic beams to be slightly moved together with the urgeable area, whilst the static strengthening bead/s is/are maximally spaced from the above movement.

The static and dynamic strengthening beads can have boundaries smoothly merging with adjacent surfaces of the urging member and can have rounded tops.

The at least two dynamic strengthening beads can be constituted by a plurality of beads having the same or different shapes and/or dimensions. For example, the dynamic strengthening beads can be in the form of a plurality of relatively small beads having a circular shape in the plan view of the urging member. Alternatively, the at least two dynamic strengthening beads can each have an elongate shape, e.g., arcuate shape.

The urging member can comprise a number of planes of symmetry, in each of which the central axis lies, and the at least two dynamic strengthening beads can be located on two sides of one of the planes of symmetry and can be spaced apart from each other by circumferential spacings located on different sides of another plane of symmetry. Lateral portions of the urging member associated with the circumferential spacings between the at least two dynamic strengthening beads can merge smoothly with the central portion. Intermediate zones located between the static and dynamic strengthening beads can merge smoothly with the lateral portions.

The dynamic beads can be so located around the central axis that the shape of the central portion inscribed therebetween corresponds to the shape of the at least one static strengthening bead which in turn can correspond to the shape of the entire urging member. For example, if the shape of the urging member and of the static strengthening bead is oval, the dynamic strengthening beads can have such a shape and be so located and oriented that the shape of the central portion inscribed therebetween is also oval, and if the shape of the urging member and of the static strengthening bead is circular, the dynamic strengthening beads can have such a shape and be so located and oriented that the shape of the central portion inscribed between the at least two dynamic strengthening beads is also circular. It should be understood that the above shapes can be best seen in the plan view of the urging member with its outer side facing upward.

The circumferential spacings between dynamic strengthening beads defined by the distance between adjacent ends thereof can be similar to the corresponding length of these beads. When the at least two dynamic strengthening beads are constituted by two such beads, and the shape of the central portion inscribed therebetween is circular, the two dynamic strengthening beads can each extend along an arc having length in the range of 75-100 degrees. More particularly, the two beads can each extend along an arc having a length in the range of 80-90 degrees, and the neighbouring ends of the two beads can be spaced from each other by the circumferential spacing having an angular length between 100-90 degrees, respectively.

Figure 15:
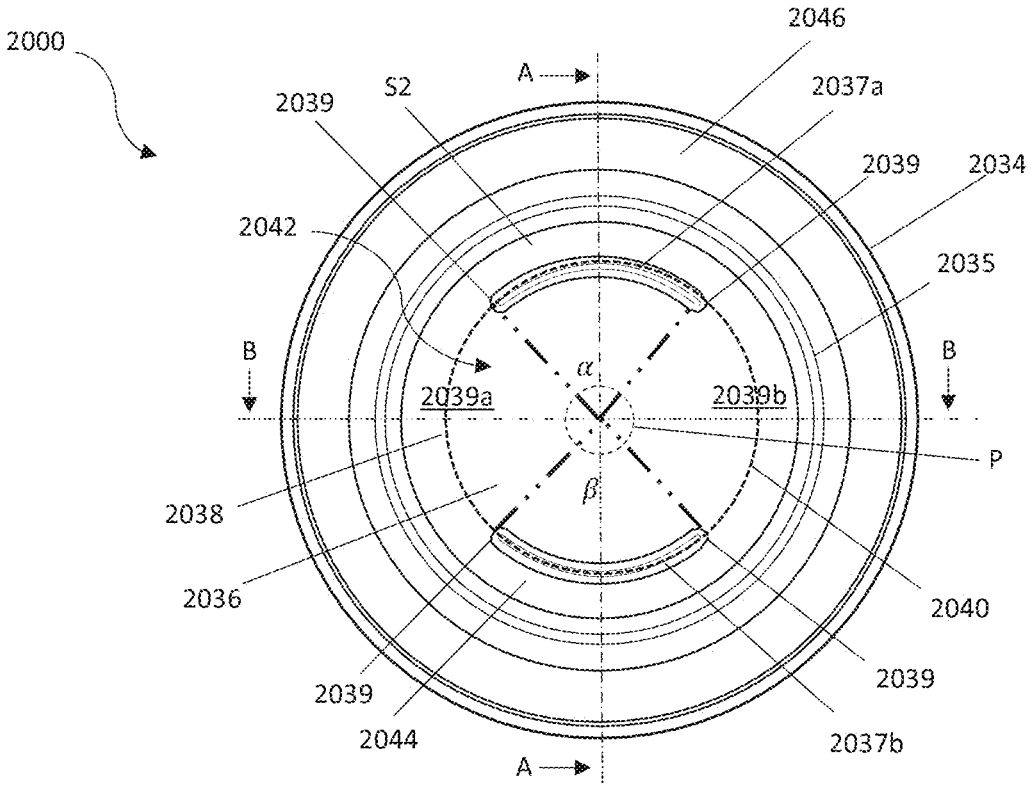
FIG. 15 illustrates a plan view of an urging member configured to constitute a base for a can, according to a still further embodiment of the presently disclosed subject matter, with an urgeable area thereof being in a normal state.
Figure 16:
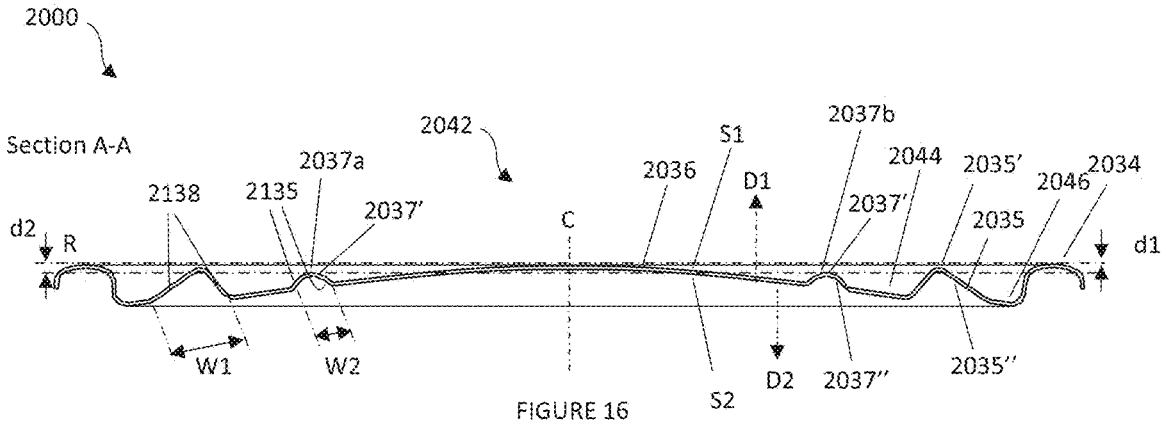
FIG. 16 illustrates a cross-sectional view of the urging member of FIG. 15, taken along a central plane of symmetry A-A.
Figure 17:
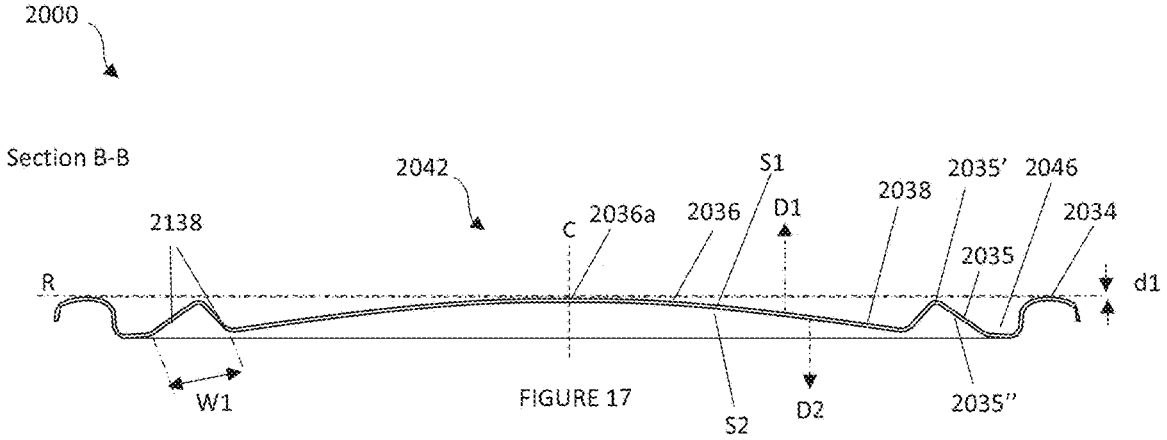
FIG. 17 illustrates a cross-sectional view of the urging member of FIG. 15, taken along a central plane of symmetry B-B.
Figure 18:
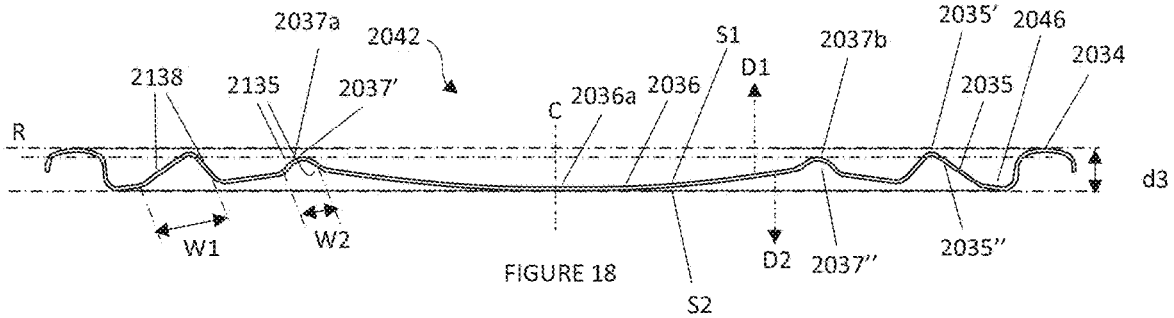
FIG. 18 illustrates a cross-sectional view of the urging member of FIG. 15, with the urgeable area thereof being in a deformed state.

FIGS. 15 to 17 schematically illustrate one example of an urging member of the above kind, with its urgeable area in the normal state, and FIG. 18 illustrates the urging member with its urgeable area in the deformed state. Whilst in FIGS. 15-18 the urging member is shown by itself, the description below is equally applicable to a can base constituted by such member.

FIG. 15 illustrates a plan view of an urging member designated as 2000, and FIGS. 16 and 17 illustrate cross-sectional views of the urging member 2000 taken along respective planes A-A and B-B in FIG. 15. In this example, these planes constitute two mutually perpendicular planes of symmetry of the urging member 2000 comprising its central axis C.

The urging member 2000 comprises an inner side S2 configured to face toward the interior of a can and an outer side S1 configured to face toward the exterior of the can, when the urging member 2000 constitutes a part of the can. The inner side S2 defines an inward direction D2 of the urging member 2000, and the outer side S1 defines an outward direction D1 of the urging member 2000.

The urging member 2000 further comprises a circular peripheral edge 2034 that is centered about the central axis C and has an outermost surface defining a reference plane R of the urging member shown in FIGS. 16 and 17. A static strengthening bead 2035 is located adjacent to the peripheral edge 2034 of the base 2000 and has a continuous circular shape about the central axis C. The static strengthening bead 2035 is spaced from the peripheral edge 2034 of the urging member 2000 by a static recess 2046 having a circular shape.

A first and a second dynamic strengthening bead 2037*a* and 2037*b* having rounded ends 2039 are located on opposing sides of the plane of symmetry A-A, and are spaced apart from each other by circumferential spacings 2039*a* and 2039*b* located on different sides of the plane of symmetry B-B. Furthermore, the dynamic strengthening beads 2037*a*, 2037*b* are spaced equally along the perimeter of a circle 2040 that is inscribed therebetween and centered about the central axis C. The dynamic strengthening beads 2037*a*, 2037*b* extend along arc lengths of the circle 2040 having the respective angles $\alpha$ and $\beta$, wherein $\alpha$ and $\beta$ both equal 87°.

With reference to FIG. 16, the static and dynamic strengthening beads have rounded tops 2035', 2037', spaced from the reference plane to different distances d1 and d2 respectively, D2 being greater than D1. The beads have bottoms 2035", 2037" having respective different widths W1 and W2, W1 being greater than W2, and the beads have side walls 2135, 2138 having different slope angles. This geometry of the dynamic beads and relatively short length relative to that of the static strengthening bead, cause the dynamic beads to have lower strengthening ability than that of the static bead.

The urging member 2000 comprises a central portion 2036 that is centered about the central axis C and defined by the circle 2040 (shown in FIG. 15) inscribed between the first and second dynamic strengthening beads 2037*a* and 2037*b*. The dynamic strengthening beads 2037*a* and 2037*b* and the circumferential spacings 2039*a*, 2039*b* are considered to be bounding the central portion 2036. Lateral portions 2038 associated with the circumferential spacings 2039*a* and 2039*b* between the dynamic strengthening beads 2037*a*, 2037*b* smoothly merge with the central portion 2036. Intermediate zones 2044 located between the static strengthening bead 2035 and the dynamic strengthening beads 2037*a*, 2037*b* smoothly merge with the lateral portions 2038.

The dimensions, shape and locations of the dynamic strengthening beads are such as to allow at least the central portion 2036 to be repeatedly elastically displaced, a predetermined number of times, by the manual application and release of an inwardly directed urging force by finger/s of a user, thus functioning as at least a part of an urgeable area 2042 of the urging member 2000, displaceable from its normal state shown in FIGS. 15 to 17 to the deformed state shown in FIG. 18. The dynamic strengthening beads thus constitute urgeability-providing elements of the urging member 2000.

As seen in FIGS. 15 and 16, in the normal state of the urgeable area 2042 of the urging member 2000, the central portion 2036 is convexly curved towards the central axis C so that its normally-outermost surface 2036*a* is located at a distance d1 from the reference plane R which is smaller than the distance d2 between the tops of the dynamic strengthening beads and the reference plane R. The normally-outermost surface 2036*a* has a circular perimeter P, shown in dashed lines, that is centered about the central axis C. As seen in FIG. 18, when the urgeable area 2042 is displaced into its deformed state, the normally-outermost surface 2036*a* of the central portion 2036 is spaced from the reference plane R to a distance d3 which is greater than the distance d2 between the tops of the dynamic strengthening beads and the reference plane R. Upon release of the urging force, the urgeable area 2042 returns from the deformed state to the normal state.

Figure 19:
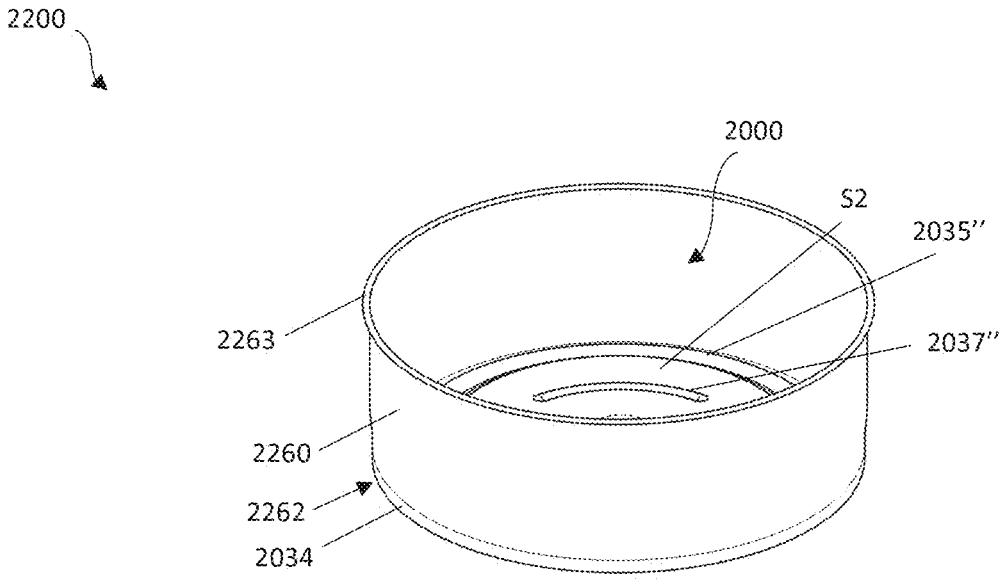
FIG. 19 illustrates a perspective view of a semi-fabricated can having the base of FIG. 15.

FIG. 19 illustrates a perspective view of a semi-fabricated can 2200 having a base in the form of the urging member 2000 described above with reference to FIGS. 15-18. The semi-fabricated can comprises a cylindrical side wall 2260 having a base end 2262 at which the peripheral edge 2034 of the urging member 2000 is connected to the can side wall 2260, and an open end 2263 configured for hermetically mounting a lid thereto after the semi-fabricated can is filled through its open end with contents including liquid and solid components. The urging member 2000 can be connected to the side wall either by forming them as a unitary body or by fixedly and sealingly mounting the urging member at the peripheral edge thereof to the base end of the can side wall.

Figure 20:
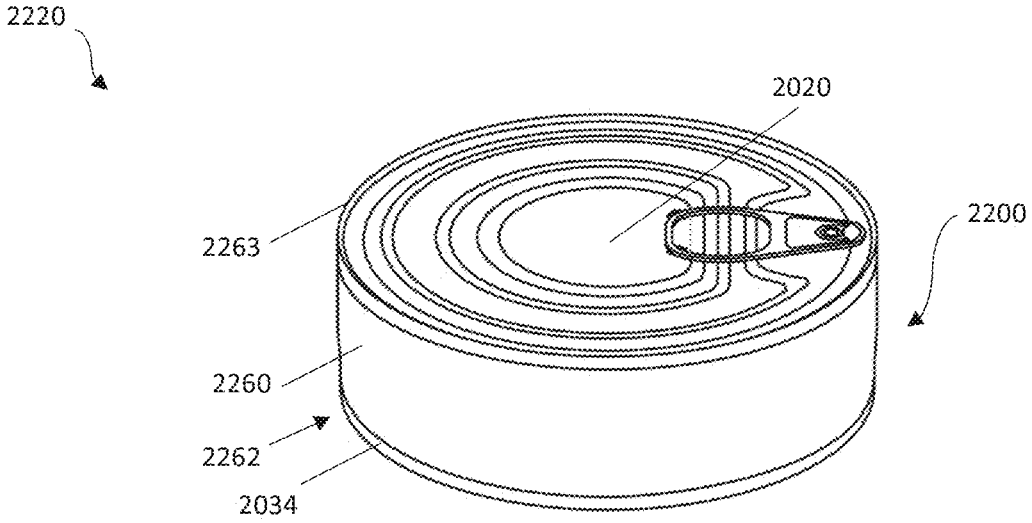
FIG. 20 illustrates a can made of the semi-fabricated can of FIG. 19 and a lid.

FIG. 20 illustrates a can 2220 made of the semi-fabricated can of FIG. 19 and a lid 2020 mounted to the open end 2263 of the can side wall 2260.

The invention claimed is:

1. An urging member for a can, the urging member having a central axis passing through a center of the urging member along a thickness direction thereof, the urging member comprising:

an inner side configured to face toward an interior of the can and an outer side configured to face toward an exterior of the can, when the urging member constitutes a base of the can, the inner side defining an inward direction of the urging member and the outer side defining an outward direction of the urging member;

a peripheral edge, at which the urging member is to be connected to a side wall of a can at one end thereof to form a semi-fabricated can, the peripheral edge having a surface which is an outermost surface in the outward direction, said outermost surface defining a reference plane of the urging member perpendicular to the central axis thereof;

at least one static strengthening bead having a top at the outer side of the urging member and a bottom at the inner side of the urging member, the strengthening bead extending along the peripheral edge, and the top being spaced from the bottom of the strengthening bead in the outward direction of the urging member to a distance not exceeding a distance between the bottom and the reference plane;

at least two dynamic strengthening beads located between the at least one static strengthening bead and the central axis and having a top at the outer side of the urging member and a bottom at the inner side of the urging member, the top of each dynamic strengthening bead being spaced from the respective bottom in the outward direction of the urging member and being located father from the reference plane than the top of the at least one static strengthening bead; the at least two dynamic strengthening beads being equally radially spaced from the central axis and being spaced apart from each other about the central axis by circumferential spacings;

a central portion surrounding the central axis and bounded by said at least two dynamic strengthening beads and the circumferential spacings, the central portion constituting at least a part of an urgeable area having a normal state in which said area is convexly curved toward the central axis in the outward direction and in which a normally-outermost surface of said central portion is disposed closer to the reference plane than the tops of said at least two dynamic strengthening beads, the urgeable area being repeatably elastically displaceable, when the peripheral edge of the urging member is fixed in place, in the following directions:

(a) in the inward direction of the urging member, upon the manual application of an urging force to the urgeable area by at least one finger of a user, thereby changing the state of the urgeable area from said normal state to a deformed state, in which said normally-outmost surface of the central portion is spaced from the reference plane to a greater distance than said tops of said at least two dynamic strengthening beads are spaced from said reference plane; and (b) in the outward direction upon release of said urging force, thereby changing the state of said urgeable area from the deformed state to said normal state.

2. The urging member according to claim 1, wherein said central portion is defined by a circle inscribed between said at least two dynamic strengthening beads.

3. The urging member according to claim 2, wherein said at least two dynamic strengthening beads have equal lengths and are equally spaced about said central axis.

4. The urging member according to claim 1, wherein each of said at least two dynamic strengthening beads has an arcuate shape.

5. The urging member according to claim 1, wherein said at least two dynamic strengthening beads are constituted by two identical beads.

6. The urging member according to claim 1, wherein each of said at least two dynamic strengthening beads extends between two ends thereof; each pair of neighbouring ends of the dynamic beads being spaced from each other by the circumferential spacing therebetween.

7. The urging member according to claim 6, wherein each of said two dynamic strengthening beads extends along an arc length in the range of 75-100 degrees.

8. The urging member according to claim 1, wherein said static strengthening bead has a continuous circular shape about said central axis.

9. The urging member according to claim 8, wherein said static strengthening bead is spaced from the peripheral edge of the urging member at least by a static recess having a circular shape about the central axis.

10. The urging member according to claim 1, wherein the thickness of the urging member is constant at least along a majority of an area thereof.

11. An urging member according to claim 6, wherein each of said two dynamic strengthening beads extends along an arc length in the range of 80 and 90 degrees.

12. A semi-fabricated can having a base constituted by the urging member according to claim 1 and a cylindrical can side wall to which the urging member is connected at the peripheral edge thereof.

13. A method of producing a semi-fabricated can having a can side wall and an urging member and being free of a lid, the method comprising;

providing the urging member of claim 1, made from a piece of a metal material; providing a cylindrical can side wall having a can wall base end, and fixedly and sealingly connecting said urging member at the peripheral edge thererof to said can wall base end to constitute a can base in such an orientation that the inner side thereof faces toward a space defined by the can wall and the outer side thereof faces away from said space.

14. A method of producing a semi-fabricated can free of a lid, the method comprising providing a piece of a metal material and using said piece to form a unitary body comprising the can side wall and a base in the form of the urging member of claim 1, in such an orientation of the urging member that the inner side thereof faces toward a space defined by the can side wall and the outer side thereof faces away from said space.

15. A can comprising the semi-fabricated can of claim 13 and an openable lid attached thereto.

16. A can comprising the semi-fabricated can of claim 14 and an openable lid attached thereto.

17. A can for containing a product comprising at least one solid component and at least one liquid component, the can with the product at least in a ready-for-sale state comprising a lid hermetically sealing the can and at least partially openable to allow at least partial removal of the product from the can, a base opposite the lid and a side wall extending therebetween;

the base being in the form of an urging member according to claim 1 operable, only when the lid is at least partially opened, to be repeatedly urged inwardly by a user applying thereto the urging force, thereby causing the urging member to function as a membrane in a pump directed to pump out the at least one liquid component from the can via the at least partially opened lid.

18. A can according to claim 17, wherein the urging member is elastically deformable between the normal and deformed states by the respective application and release of the urging force a number of times, said number being at least more than twenty.

19. A can according to claim 17, wherein in the normal state of the urging member, the urging member is generally convex in shape, and in the deformed state of the urging member, the urging member is generally concave in shape.

20. A can according to claim 17, wherein the ready-for-sale state of the can is a state which the can with the product has after having undergone an entire manufacturing process.

21. A can according to claim 20, wherein during said process, the can with the product is configured to withstand pressure differential between the inside and outside of the can of 150 KPa without buckling.

22. A can according to claim 17, wherein the product is a food product.

23. A can according to claim 17, wherein the product is tuna.

24. A can for containing a product comprising at least one solid component and at least one liquid component, the can with the product at least in a ready-for-sale state, the can comprising:

a lid bermetically sealing the can and at least partially openable to allow at least partial removal of the product from the can;

a base opposite the lid and a side wall extending therebetween;

the base being in the form of an urging member, the urging member having a central axis passing through a center of the urging member along a thickness direction thereof, the urging member comprising:

an inner side configured to face toward an interior of the can and an outer side configured to face toward an exterior of the can, the inner side defining an inward direction of the urging member and the outer side defining an outward direction of the urging member;

a peripheral edge, at which the urging member is connected to the side wall at one end thereof, the peripheral edge having a surface which is an outermost surface in the outward direction, said outermost surface defining a reference plane of the urging member perpendicular to the central axis thereof;

an urgeable area surrounding said axis and having a normal state in which at least a part of said area is outwardly convexly curved toward the central axis at the outer side of the urging member;

a pattern of elements formed in the urging member and located between said peripheral edge and said central axis, the elements comprising at least one strengthening rib having a top at the outer side of the urging member and a bottom at the inner side of the urging member, the strengthening rib extending along the peripheral edge, and the top being spaced from the bottom of the strengthening rib in the outward direction of the urging member to a distance not exceeding that of a distance between the bottom and the reference plane; and a number of urgeability-providing elements located between the central axis and the at least one strengthening rib, said urgeability-providing elements being angularly spaced from each other about the central axis, being radially spaced from the strengthening rib and being configured to provide said urgeable area with the ability to be repeatably elastically displaceable, when the peripheral edge of the urging member is fixed in place, in the following directions:

(a) in the inward direction of the urging member, upon the manual application of an urging force to the urgeable area by at least one finger of a user, thereby changing the state of the urgeable area from a normal state in which the central portion of the area is disposed at a first location with respect to the reference plane, to a deformed state in which said central portion is disposed at a second location spaced from the reference plane to a greater distance than in the normal state; and (b) in the outward direction upon release of said urging force, thereby changing the state of said urgeable area from the deformed state to said normal state, wherein, the urging member is operable, only when the lid is at least partially opened, to be repeatedly urged inwardly by a user applying thereto the urging force, thereby causing the urging member to function as a membrane in a pump directed to pump out the at least one liquid component from the can via the at least partially opened lid.

* * * * *